US007951750B2

(12) United States Patent
Arai et al.

(10) Patent No.: US 7,951,750 B2
(45) Date of Patent: May 31, 2011

(54) IMAGE-FORMING METHOD USING THERMAL TRANSFER SYSTEM

(75) Inventors: Takuya Arai, Minami-ashigara (JP); Kazuaki Oguma, Minami-ashigara (JP); Toshihide Yoshitani, Minami-ashigara (JP); Masataka Yoshizawa, Minami-ashigara (JP); Yoshihisa Tsukada, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 1014 days.

(21) Appl. No.: 11/715,873

(22) Filed: Mar. 9, 2007

(65) Prior Publication Data

US 2007/0213221 A1 Sep. 13, 2007

(30) Foreign Application Priority Data

Mar. 9, 2006 (JP) ..... 2006-064931

(51) Int. Cl.
*B41M 5/035* (2006.01)
*B41M 5/50* (2006.01)
*B44C 1/17* (2006.01)

(52) U.S. Cl. ..... 503/227; 156/235; 428/32.39

(58) Field of Classification Search ..... None
See application file for complete search history.

(56) References Cited

U.S. PATENT DOCUMENTS 7,485,402 B2 * 2/2009 Arai et al. ..... 430/201

FOREIGN PATENT DOCUMENTS

| | | | |
|---|---|---|---|
| JP | 63-051189 | A | 3/1988 |
| JP | 63-56489 | A | 3/1988 |
| JP | 1-291990 | A | 11/1989 |
| JP | 4-107547 | A | 4/1992 |
| JP | 04-332690 | A | 11/1992 |
| JP | 7-17149 | A | 1/1995 |
| JP | 7-101170 | A | 4/1995 |
| JP | 7-232481 | A | 9/1995 |
| JP | 9-220863 | | 8/1997 |
| JP | 11-227345 | A | 8/1999 |
| JP | 2000-309172 | A | 11/2000 |
| JP | 2001-071650 | A | 3/2001 |
| JP | 2004-025830 | A | 1/2004 |
| JP | 2004-284113 | A | 10/2004 |
| JP | 2005-313619 | A | 11/2005 |
| JP | 2005-335115 | A | 12/2005 |
| JP | 2005-335375 | A | 12/2005 |

* cited by examiner

*Primary Examiner* — Bruce H Hess
(74) *Attorney, Agent, or Firm* — Sughrue Mion, PLLC

(57) ABSTRACT

An image-forming method, having: superposing a heat-sensitive transfer sheet on a heat-sensitive transfer image-receiving sheet so that at least one receptor layer of the heat-sensitive transfer image-receiving sheet can be contacted with a thermal transfer layer of the heat-sensitive transfer sheet; and providing thermal energy in accordance with image signals given from a thermal head, thereby to form an image; wherein the heat-sensitive transfer sheet has the thermal transfer layer that contains a thermally transferable colorant on one surface of a substrate film, and a heat-resistant sliding layer that is formed so as to contain a hardener on the other surface; and wherein the heat-sensitive transfer image-receiving sheet has, on a support, the at least one receptor layer that contains a latex polymer, and at least one heat insulation layer that contains hollow polymer particles but does not contain a resin having poor resistance to an organic solvent.

14 Claims, 1 Drawing Sheet

IMAGE-FORMING METHOD USING THERMAL TRANSFER SYSTEM

FIELD OF THE INVENTION

The present invention relates to an image-forming method using a thermal transfer system (heat-sensitive transfer system). In particular, the present invention relates to an image-forming method by which a print having a high density and an excellent image quality without a failure such as unevenness and wrinkle can be provided with neither welding between an ink sheet and a thermal head nor welding between an ink sheet and an image-receiving sheet, even if a high speed printing is performed.

BACKGROUND OF THE INVENTION

Various heat transfer recording methods have been known so far. Among these methods, dye diffusion transfer recording systems attract attention as a process that can produce a color hard copy having an image quality closest to that of silver salt photography see, for example, "Joho Kiroku (Hard Copy) to Sono Zairyo no Shintenkai (Information Recording (Hard Copy) and New Development of Recording Materials)" published by Toray Research Center Inc., 1993, pp. 241-285; and "Printer Zairyo no Kaihatsu (Development of Printer Materials)" published by CMC Publishing Co., Ltd., 1995, p. 180). Moreover, this system has advantages over silver salt photography: it is a dry system, it enables direct visualization from digital data, it makes reproduction simple, and the like.

In this dye diffusion transfer recording system, a heat-sensitive (thermal) transfer sheet (hereinafter also referred to as an ink sheet) containing dyes is superposed on a heat-sensitive (thermal) transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

An example of fields in which new applications of this dye diffusive transfer recording system are being developed, is that of heat transfer recording labels, or heat transfer recording tags, for use in POS (Point Of Sales) systems. It is relatively unusual for this system to be used in severe conditions for a long period of time, in current food label applications and cloth tag applications. However, opportunities to use this system have increased in distribution management applications such as delivery labels and air baggage tags, and it is demanded of this system to enable precise recording of, for example, bar codes, and to provide a high-quality image. Also, it is desired to improve the paper strength of heat transfer recording image-receiving paper, because there is the case in which a recording material is exposed to severe conditions.

JP-A-9-220863 ("JP-A" means unexamined published Japanese patent publication) discloses that crepe paper or extensible paper is used as a support of the image-receiving sheet. However, when this crepe paper or extensible paper is used as the support, there is the problem that moisture is absorbed in the paper during the course of the process from coating step to drying step, and also the moisture remains in the paper even after the paper is dried, causing a reduction in the sharpness of a receptor layer over time.

In the image formation that is performed using the above-described thermal transfer sheet with a thermal head, when the processing for the image formation is conducted at a high speed, and if a substrate film is a thermoplastic film such as a polyester film, problems arise that the thermal head welds with the substrate film of an ink sheet because the thermal head has been heated at a high temperature, so that an excellent traveling of the thermal head is deteriorated, and thereby a failure such as breakage and wrinkle occurs in the thermal transfer sheet. Besides, when the processing is conducted at a high speed in the image formation, another problem arises that a time necessary to transfer a heat from the thermal head is so short that it is difficult to obtain a high density image.

SUMMARY OF THE INVENTION

The present invention resides in an image-forming method, which comprises the steps of:

superposing a heat-sensitive transfer sheet on a heat-sensitive transfer image-receiving sheet so that at least one receptor layer of the heat-sensitive transfer image-receiving sheet described below can be contacted with a thermal transfer layer of the heat-sensitive transfer sheet described below; and providing thermal energy in accordance with image signals given from a thermal head, thereby to form an image;

wherein the heat-sensitive transfer sheet comprises: said thermal transfer layer that contains a thermally transferable color material on one surface of a substrate film; and a heat-resistant sliding layer that is formed so as to contain a hardener on the other surface of the substrate film; and wherein the heat-sensitive transfer image-receiving sheet comprises: on a support, said at least one receptor layer that contains a latex polymer; and at least one heat insulation layer that contains hollow polymer particles, and that does not contain a resin having poor resistance to an organic solvent, other than the hollow polymer particles.

Other and further features and advantages of the invention will appear more fully from the following description, appropriately referring to the accompanying drawing.

DETAILED DESCRIPTION OF THE INVENTION

Figure 1:
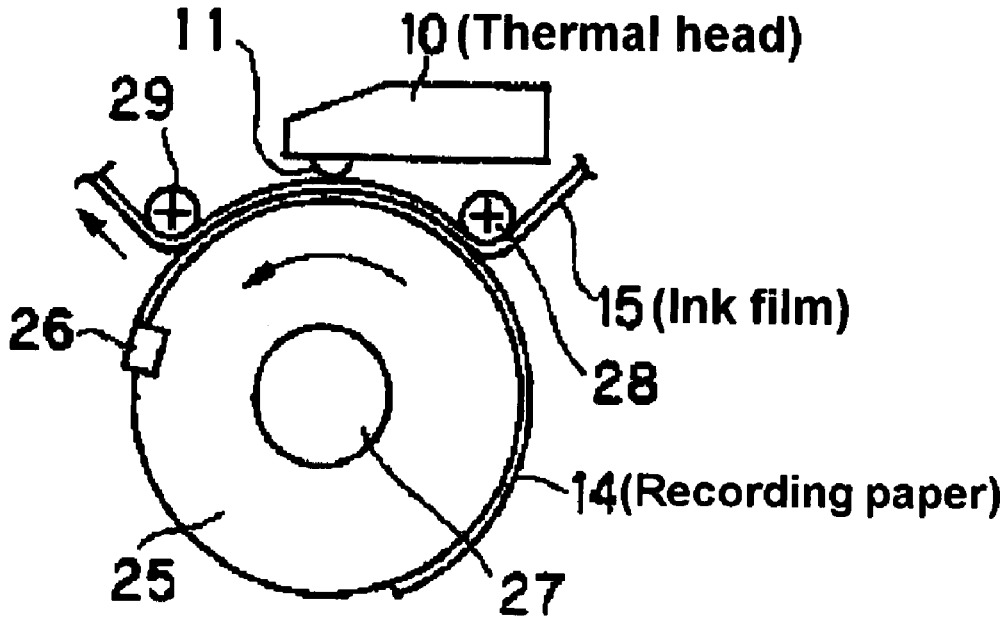
FIG. 1 is an illustration of a thermal recording apparatus that can be used for heat-sensitive transfer recording according to the present invention.

The inventors of the present invention, having studied keenly, found that both welding of a thermal head and an ink sheet and welding of the ink sheet and an image-receiving sheet can be prevented from occurring even upon high-speed processing, and that speedups of printing can be achieved. Further, the inventors of the present invention found that images of high densities can be formed, even upon such a high-speed processing, as far as the image-receiving sheet has a heat insulation (or thermal barrier) layer containing highly adiathermic (or heat insulation) hollow particles. The present invention was thus attained based on those findings.

According to the present invention, there is provided the following means:

(1) An image-forming method, comprising the steps of:

superposing a heat-sensitive transfer sheet on a heat-sensitive transfer image-receiving sheet so that at least one receptor layer of the heat-sensitive transfer image-receiving sheet described below can be contacted with a thermal transfer layer of the heat-sensitive transfer sheet described below; and providing thermal energy in accordance with image signals given from a thermal head, thereby to form an image;

wherein the heat-sensitive transfer sheet comprises: said thermal transfer layer that contains a thermally transferable color material (colorant) on one surface of a substrate film; and a heat-resistant sliding layer that is formed so as to contain a hardener on the other surface of the substrate film; and wherein the heat-sensitive transfer image-receiving sheet comprises: on a support, said at least one receptor layer that contains a latex polymer; and at least one heat insulation layer that contains hollow polymer particles, and that does not contain a resin having poor resistance to an organic solvent, other than the hollow polymer particles;

(2) The image-forming method as described in the above item (1), wherein at least one of the receptor layer and the heat insulation layer further contains a water-soluble polymer;

(3) The image-forming method as described in the above item (1) or (2), wherein at least one of the receptor layer containing the water-soluble polymer and the heat insulation layer containing the water-soluble polymer further contains a compound (i.e. a cross-linking agent) capable of forming crosslinkages between molecules of the water-soluble polymer, and the compound brings a part or all of the water-soluble polymer molecules into being crosslinked;

(4) The image-forming method as described in any one of the above items (1) to (3), wherein the heat-resistant sliding layer contains a polymer obtained by reacting a compound having two or more isocyanate groups with a polymer;

(5) The image-forming method as described in any one of the above items (1) to (4), wherein a thickness of the heat-resistant sliding layer is in the range of 0.1 to 2.0 μm;

(6) The image-forming method as described in any one of the above items (1) to (5), wherein the latex polymer is a vinyl chloride-based latex polymer;

(7) The image-forming method as described in any one of the above items (1) to (6), wherein the heat-sensitive transfer sheet comprises at least one kind of a dye represented by formula (7) or (8):

Formula (7)

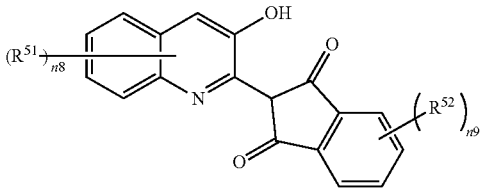

wherein, in formula (7), $R^{51}$ and $R^{52}$ each independently represent a substituent; n8 represents an integer of 0 to 5; and n9 represents an integer of 0 to 4; and Formula (8)

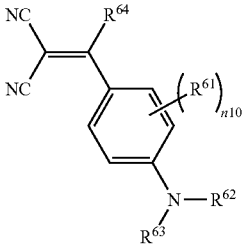

wherein, in formula (8), $R^{61}$ represents a substituent; $R^{62}$, $R^{63}$ and $R^{64}$ each independently represent a hydrogen atom or a substituent; and n10 represents an integer of 0 to 4;

(8) The image-forming method as described in any one of the above items (1) to (7), wherein the heat-sensitive transfer sheet comprises at least one kind of a dye represented by any one of formulae (9), (10) and (11):

Formula (9)

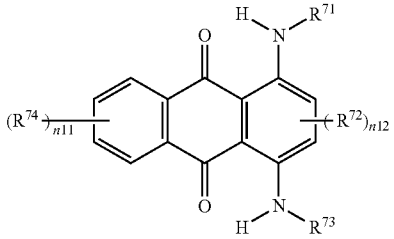

wherein, in formula (9), $R^{71}$ and $R^{73}$ each independently represent a hydrogen atom or a substituent; $R^{72}$ and $R^{74}$ each independently represent a substituent; n11 represents an integer of 0 to 4; and n12 represents an integer of 0 to 2;

Formula (10)

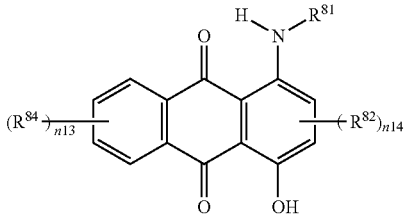

wherein, in formula (10), $R^{81}$ represents a hydrogen atom or a substituent; $R^{82}$ and $R^{84}$ each independently represent a substituent; n13 represents an integer of 0 to 4; and n14 represents an integer of 0 to 2; and Formula (11)

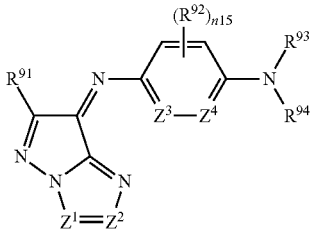

wherein, in formula (11), $R^{91}$ represents a hydrogen atom or a substituent; $R^{92}$ represents a substituent; $R^{93}$ and $R^{94}$ each independently represent a hydrogen atom or a substituent; n15 represents an integer of 0 to 2; one of $Z^1$ and $Z^2$ represents =N— and the other represents =C($R^{95}$)—; $Z^3$ and $Z^4$ each independently represents =N— or =C($R^{95}$)—; and $R^{95}$ represents a hydrogen atom or a substituent;

(9) The image-forming method as described in any one of the above items (1) to (8), wherein the heat-sensitive transfer sheet comprises at least one kind of a dye represented by formula (12) or (13):

Formula (12)

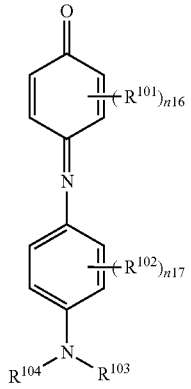

wherein, in formula (12), $R^{101}$ and $R^{102}$ each independently represent a substituent; $R^{103}$ and $R^{104}$ each independently represent a hydrogen atom or a substituent; and n16 and n17 each independently represent an integer of 0 to 4; and Formula (13)

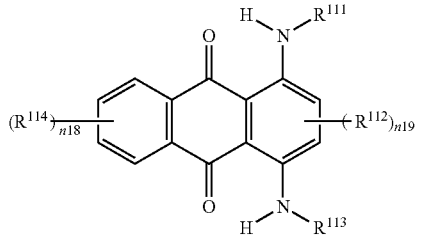

wherein, in formula (13), $R^{111}$ and $R^{113}$ each independently represent a hydrogen atom or a substituent; $R^{112}$ and $R^{114}$ each independently represent a substituent; n18 represents an integer of 0 to 4; and n19 represents an integer of 0 to 2; and

(10) The image-forming method as described in any one of the above items (1) to (9), wherein a transport speed of the heat-sensitive transfer image-receiving sheet at the time of image-forming is 125 mm per second or more.

The present invention will be explained in detail below.

The heat-sensitive transfer image-receiving sheet for use in the present invention is provided with a dye-receiving layer (receptor layer) formed on a support (substrate). It is preferable to form an undercoat layer between the receptor layer and the support. As the undercoat layer, for example, any of a white background control layer, a charge control layer, an adhesive layer and a primer layer is/are formed. Also, a heat insulation layer is preferably formed between the undercoat layer and the support. It is preferable that a curling control layer, a writing layer, or a charge-control layer be formed on the backside of the support. Each of these layers is applied using a usual method such as a roll coating, a bar coating, a gravure coating, and a gravure reverse coating.

(Receptor Layer)

The receptor layer plays a roll as receptor of dyes to be transferred from the ink sheet and a roll as retainer of the image thus-formed. The image-receiving sheet according to the present invention has at least one receptor layer that contains a latex polymer and a water-soluble polymer. By containing both the latex polymer and the water-soluble polymer, molecules of the water-soluble polymer that is hard to be dyed with a dye can exist at a space among the latex polymer particles, thereby to prevent the dyes which dye the latex polymer from being diffused. Thus, change in sharpness of the receptor layer with the lapse of time can be reduced, and an image for recording of the thus-transferred image, which is less in change with the lapse of time, can be formed.

<Latex Polymer>

The polymer latex for use in the present invention is described below. In the heat-sensitive transfer image-receiving sheet for use in the present invention, the polymer latex for use in the receptor layer is a dispersion in which water-insoluble hydrophobic polymers are dispersed as fine particles in a water-soluble dispersion medium. The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. Latex polymers are described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki, and Keishi Kasahara, issued by Kobunshi Kanko Kai (1993); Soichi Muroi, "Gosei Latex no Kagaku (Chemistry of Synthetic Latex)", issued by Kobunshi Kanko Kai (1970); Yoshiaki Miyosawa (supervisor) "Suisei Coating-Zairyo no Kaihatsu to Oyo (Development and Application of Aqueous Coating Material)", issued by CMC Publishing Co., Ltd. (2004) and JP-A-64-538, and so forth. The dispersed particles preferably have a mean particle size (diameter) of about 1 to 50,000 nm, more preferably about 5 to 1,000 nm. The particle size distribution of the dispersed particles is not particularly limited, and the particles may have either wide particle-size distribution or monodispersed particle-size distribution.

The latex polymer for use in the present invention may be latex of the so-called core/shell type, other than ordinary latex polymer of a uniform structure. When using a core/shell type latex polymer, it is preferred in some cases that the core and the shell have different glass transition temperatures. The glass transition temperature (Tg) of the latex polymer for use in the present invention is preferably −30° C. to 130° C., more preferably 0° C. to 100° C., and further preferably 11° C. to 80° C.

In the present invention, as preferable types of latex polymer, hydrophobic polymers such as acrylic polymers, polyesters, rubbers (e.g., SBR resins), polyurethanes, polyvinyl chlorides, polyvinyl acetates, polyvinylidene chlorides, and polyolefins, are preferably used. These polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number average molecular weight. Polymers having excessively small molecular weight impart insufficient dynamic strength to the layer containing the latex, and polymers having excessively large molecular weight bring about poor filming ability. Crosslinkable latex polymers are also preferably used.

In the present invention, of the latex polymers recited as above, a vinyl chloride-based latex polymer is preferred.

No particular limitation is imposed on the monomer to be used in synthesizing the latex polymer that can be used in the present invention, and the following monomer groups (a) to (j) may be preferably used as those polymerizable in a usual radical polymerization or ion polymerization method. These monomers may be selected singly or combined freely to synthesize a latex polymer.

-Monomer Groups (a) to (j)-

(a) Conjugated dienes: 1,3-pentadiene, isoprene, 1-phenyl-1, 3-butadiene, 1-α-naphthyl-1,3-butadiene, 1-β-naphthyl-1, 3-butadiene, cyclopentadiene, etc.

(b) Olefins: ethylene, propylene, vinyl chloride, vinylidene chloride, 6-hydroxy-1-hexene, 4-pentenoic acid, methyl 8-nonenate, vinylsulfonic acid, trimethylvinylsilane, trimethoxyvinylsilane, 1,4-divinylcyclohexane, 1,2,5-trivinylcyclohexane, etc (c) α,β-unsaturated carboxylates: alkyl acrylates such as methyl acrylate, ethyl acrylate, butyl acrylate, cyclohexyl acrylate, 2-ethylhexyl acrylate, and dodecyl acrylate; substituted alkyl acrylates such as 2-chloroethyl acrylate, benzyl acrylate, and 2-cyanoethyl acrylate; alkyl methacrylates such as methyl methacrylate, butyl methacrylate, 2-ethylhexyl methacrylate, and dodecyl methacrylate; substituted alkyl methacrylates such as 2-hydroxyethyl methacrylate, glycidyl methacrylate, glycerin monomethacrylate, 2-acetoxyethyl methacrylate, tetrahydrofurfuryl methacrylate, 2-methoxyethyl methacrylate, polypropylene glycol monomethacrylates (mole number of added polyoxypropylene=2 to 100), 3-N,N-dimethylaminopropyl methacrylate, chloro-3-N,N,N-trimethylammoniopropyl methacrylate, 2-carboxyethyl methacrylate, 3-sulfopropyl methacrylate, 4-oxysulfobutyl methacrylate, 3-trimethoxysilylpropyl methacrylate, allyl methacrylate, and 2-isocyanatoethyl methacrylate; derivatives of unsaturated dicarboxylic acids such as monobutyl maleate, dimethyl maleate, monomethyl itaconate, and dibutyl itaconate; multifunctional esters such as ethylene glycol diacrylate, ethylene glycol dimethacrylate, 1,4-cyclohexane diacrylate, pentaerythritol tetramethacrylate, pentaerythritol triacrylate, trimethylolpropane triacrylate, trimethylolethane triacrylate, dipentaerythritol pentamethacrylate, pentaerythritol hexaacrylate, and 1,2, 4-cyclohexane tetramethacrylate; etc.

(d) α,β-unsaturated carboxylic amides: acrylamide, methacrylamide, N-methylacrylamide, N,N-dimethylacrylamide, N-methyl-N-hydroxyethylmethacrylamide, N-tert-butylacrylamide, N-tert-octylmethacrylamide, N-cyclohexylacrylamide, N-phenylacrylamide, N-(2-acetoacetoxyethyl)acrylamide, N-acryloylmorpholine, diacetone acrylamide, itaconic diamide, N-methylmaleimide, 2-acrylamide-methylpropane sulfonic acid, methylenebisacrylamide, dimethacryloylpiperazine, etc.

(e) Unsaturated nitriles: acrylonitrile, methacrylonitrile, etc.

(f) Styrene and derivatives thereof: styrene, vinyltoluene, p-tert-butylstyrene, vinylbenzoic acid, methyl vinylbenzoate, α-methylstyrene, p-chloromethylstyrene, vinylnaphthalene, p-hydroxymethylstyrene, sodium p-styrenesulfonate, potassium p-styrenesulfinate, p-aminomethylstyrene, 1,4-divinylbenzene, etc.

(g) Vinyl ethers: methyl vinyl ether, butyl vinyl ether, methoxyethyl vinyl ether, etc.

(h) Vinyl esters: vinyl acetate, vinyl propionate, vinyl benzoate, vinyl salicylate, vinyl chloroacetate, etc.

(i) α,β-unsaturated carboxylic acids and salts thereof: acrylic acid, methacrylic acid, itaconic acid, maleic acid, sodium acrylate, ammonium methacrylate, potassium itaconate, etc.

(j) Other polymerizable monomers: N-vinylimidazole, 4-vinylpyridine, N-vinylpyrrolidone, 2-vinyloxazoline, 2-isopropenyloxazoline, divinylsulfone, etc.

Latex polymers that can be used in the present invention are also commercially available, and polymers described below may be utilized.

Examples of the acrylic polymers include Cevian A-4635, 4718, and 4601 (trade names, manufactured by Daicel Chemical Industries); Nipol Lx811, 814, 821, 820, 855 (P-17: Tg 36° C.), and 857×2 (P-18: Tg 43° C.) (trade names, manufactured by Nippon Zeon Co., Ltd.); Voncoat R3370 (P-19: Tg 25° C.), and 4280 (P-20: Tg 15° C.) (trade names, manufactured by Dai-Nippon Ink & Chemicals, Inc.); Julimer ET-410 (P-21: Tg 44° C.) (trade name, manufactured by Nihon Junyaku K.K.); AE116 (P-22: Tg 50° C.), AE119 (P-23: Tg 55° C.), AE121 (P-24: Tg 58° C.), AE125 (P-25: Tg 60° C.), AE134 (P-26: Tg 48° C.), AE137 (P-27: Tg 48° C.), AE140 (P-28: Tg 53° C.), and AE173 (P-29: Tg 60° C.) (trade names, manufactured by JSR Corporation); Aron A-104 (P-30: Tg 45° C.) (trade name, manufactured by Toagosei Co., Ltd.); NS-600X, and NS-620X (trade names, manufactured by Takamatsu Yushi K.K.); VINYBLAN 2580, 2583, 2641, 2770, 2770H, 2635, 2886, 5202C, and 2706 (trade names, manufactured by Nisshin Chemical Industry Co., Ltd.).

Examples of the polyesters include FINETEX ES650, 611, 675, and 850 (trade names, manufactured by Dainippon Ink and Chemicals, Incorporated); WD-size, and WMS (trade names, manufactured by Eastman Chemical Ltd.); A-110, A-115GE, A-120, A-121, A-124GP, A-124S, A-160P, A-210, A-215GE, A-510, A-513E, A-515GE, A-520, A-610, A-613, A-615GE, A-620, WAC-10, WAC-15, WAC-17XC, WAC-20, S-110, S-110EA, S-111SL, S-120, S-140, S-140A, S-250, S-252G, S-250S, S-320, S-680, DNS-63P, NS-122L, NS-122LX, NS-244LX, NS-140L, NS-141 LX, and NS-282LX (trade names, manufactured by Takamatsu Yushi K.K.); Aronmelt PES-1000 series, and PES-2000 series (trade names, manufactured by Toagosei Co., Ltd.); Bironal MD-1100, MD-1200, MD-1220, MD-1245, MD-1250, MD-1335, MD-1400, MD-1480, MD-1500, MD-1930, and MD-1985 (trade names, manufactured by Toyobo Co., Ltd.); and Ceporjon ES (trade name, manufactured by Sumitomo Seika Chemicals Co., Ltd.).

Examples of the polyurethanes include HYDRAN AP10, AP20, AP30, AP40, and 101H, Vondic 1320NS, and 1610NS (trade names, manufactured by Dainippon Ink and Chemicals, Incorporated); D-1000, D-2000, D-6000, D-4000, and D-9000 (trade names, manufactured by Dainichi Seika Color & Chemicals Mfg. Co., Ltd.); NS-155X, NS-310A, NS-310X, and NS-311X (trade names, manufactured by Takamatsu Yushi K.K.); Elastron (trade name, manufactured by Dai-ichi Kogyo Seiyaku Co., Ltd.).

Examples of the rubbers include LACSTAR 7310K, 3307B, 4700H, and 7132C (trade names, manufactured by Dainippon Ink & Chemicals Incorporated); Nipol Lx416, LX410, LX430, LX435, LX110, LX415A, LX438C, 2507H, LX303A, LX407BP series, V1004, and MH5055 (trade names, manufactured by Nippon Zeon Co., Ltd.).

Examples of the polyvinyl chlorides include G351, and G576 (trade names, manufactured by Nippon Zeon Co., Ltd.); VINYBLAN 240, 270, 277, 375, 386, 609, 550, 601, 602, 630, 660, 671, 683, 680, 680S, 681N, 685R, 277, 380, 381, 410, 430, 432, 860, 863, 865, 867, 900, 900GT, 938, and 950 (trade names, manufactured by Nisshin Chemical Industry Co., Ltd.).

Examples of polyvinylidene chlorides include L502 and L513 (trade names, manufactured by Asahi Kasei Corporation); D-5071 (trade name, manufactured by Dai-Nippon Ink & Chemicals, Inc.).

Examples of polyolefins include Chemipearl S120, SA100, and V300 (P-40: Tg 80° C.) (trade names, manufactured by Mitsui Petrochemical); Voncoat 2830, 2210, and 2960 (trade names, manufactured by Dainippon Ink and Chemicals, Incorporated); Zaikusen and Ceporjon G (trade names, manufactured by Sumitomo Seika Chemicals Co., Ltd.).

Examples of copolymer nylons include Ceporjon PA (trade name, manufactured by Sumitomo Seika Chemicals Co., Ltd.).

Examples of the polyvinyl acetates include VINYBLAN 1080, 1082, 1085W, 1108W, 1108S, 1563M, 1566, 1570, 1588C, A22J7-F2, 1128C, 1137, 1138, A20J2, A23J1, A23J1, A23K1, A23P2E, A68J1N, 1086A, 1086, 1086D, 1108S, 1187, 1241LT, 1580N, 1083, 1571, 1572, 1581, 4465, 4466, 4468W, 4468S, 4470, 4485LL, 4495LL, 1023, 1042, 1060, 1060S, 1080M, 1084W, 1084S, 1096, 1570K, 1050, 1050S, 3290, 1017AD, 1002, 1006, 1008, 1107L, 1225, 1245L, GV-6170, GV-6181, 4468W, and 4468S (trade names, manufactured by Nisshin Chemical Industry Co., Ltd.).

These latex polymers may be used singly, or two or more of these polymers may be blended.

In the present invention, it is preferable to prepare the receptor layer by applying an aqueous type coating solution and then drying it. The "aqueous type" so-called here means that 60% by mass or more of the solvent (dispersion medium) of the coating solution is water. As components other than water in the coating solution, water miscible organic solvents may be used, such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

Although there is no particular limits to the drying time, a shorter drying time is preferable to a longer one from a production viewpoint. To be more specific, the drying time is preferably from 10 seconds to 20 minutes, far preferably from 30 seconds to 10 minutes.

The term "MFT" as used herein refers to the minimum film-forming temperature of a polymer latex, and in other words, the minimum temperature necessary for the emulsion to form a smooth transparent continuous coating. The latex polymer for use in the present invention preferably has a minimum film-forming temperature (MFT) of from −30 to 90° C., more preferably from 0 to 70° C. In order to control the minimum film-forming temperature, a film-forming aid may be added. The film-forming aid is also called a temporary plasticizer, and it is an organic compound (usually an organic solvent) that reduces the minimum film-forming temperature of the latex polymer. It is described in, for example, Souichi Muroi, "Gosei Latex no Kagaku (Chemistry of Synthetic Latex)", issued by Kobunshi Kanko Kai (1970). Preferable examples of the film-forming aid are listed below, but the compounds that can be used in the invention are not limited to the following specific examples.

Z-1: Benzyl alcohol

Z-2: 2,2,4-Trimethylpentanediol-1,3-monoisobutyrate

Z-3: 2-Dimethylaminoethanol

Z-4: Diethylene glycol

Preferable examples of the latex polymer that can be used in the present invention may include polylactates, polyurethanes, polycarbonates, polyesters, polyacetals, SBRs, and polyvinyl chlorides. It is most preferable that, among these compounds, polyesters, polycarbonates, and polyvinyl chlorides be included.

Among the above examples, the latex polymer for use in the present invention is preferably polyvinyl chlorides, more preferably a copolymer of vinyl chloride and an acrylic ester, further preferably one having a glass transition temperature (Tg) of 30 to 80° C.

In combination with the above-described polymer latex for use in the present invention, any polymer can be used. The polymer that can be used in combination is preferably transparent or translucent, and generally colorless. The polymer may be a natural resin, polymer, or copolymer; a synthetic resin, polymer, or copolymer; or another film-forming medium; and specific examples include gelatins, polyvinyl alcohols, hydroxyethylcelluloses, cellulose acetates, cellulose acetate butyrates, polyvinylpyrrolidones, caseins, starches, polyacrylic acids, polymethylmethacrylic acids, polyvinyl chlorides, polymethacrylic acids, styrene-maleic anhydride copolymers, styrene-acrylonitrile copolymers, styrene-butadiene copolymers, polyvinyl acetals (e.g. polyvinyl formals, polyvinyl butyrals, etc.), polyesters, polyurethanes, phenoxy resins, polyvinylidene chlorides, polyepoxides, polycarbonates, polyvinyl acetates, polyolefins, and polyamides. In the coating liquid, a binder may be dissolved or dispersed in an aqueous solvent or in an organic solvent, or may be in the form of an emulsion.

The glass transition temperature (Tg) of the binder for use in the invention is preferably in the range of −30° C. to 70° C., more preferably −101C to 50° C., still more preferably 0° C. to 40° C., in view of film-forming properties (brittleness for working) and image storability. A blend of two or more types of polymers can be used as the binder. When a blend of two or more polymers is used, the average Tg obtained by summing up the Tg of each polymer weighted by its proportion, is preferably within the foregoing range. Also, when phase separation occurs or when a core-shell structure is adopted, the weighted average Tg is preferably within the foregoing range.

The glass transition temperature (Tg) is calculated according to the following equation:

$$1/Tg=\Sigma(Xi/Tgi)$$

wherein, assuming that the polymer is a copolymer composed of n monomers from i=1 to i=n, Xi is a weight fraction of the i-th monomer ($\Sigma Xi=1$) and Tgi is glass transition temperature (measured in absolute temperature) of a homopolymer formed from the i-th monomer. The symbol L means the sum of i=1 to i=n. The value of the glass transition temperature of a homopolymer formed from each monomer (Tgi) is adopted from J. Brandrup and E. H. Immergut, "Polymer Handbook, 3rd. Edition", Wiley-Interscience (1989).

The polymer used for the binder for use in the present invention can be easily obtained by a solution polymerization method, a suspension polymerization method, an emulsion polymerization method, a dispersion polymerization method, an anionic polymerization method, a cationic polymerization method, or the like. Above all, an emulsion polymerization method in which the polymer is obtained as a latex is the most preferable. Also, a method is preferable in which the polymer is prepared in a solution, and the solution is neutralized, or an emulsifier is added to the solution, to which water is then added, to prepare an aqueous dispersion by forced stirring. For example, an emulsion polymerization method comprises conducting polymerization under stirring at about 30° C. to about 100° C. (preferably 60° C. to 90° C.) for 3 to 24 hours by using water or a mixed solvent of water and a water-miscible organic solvent (such as methanol, ethanol, or acetone) as a dispersion medium, a monomer mixture in an amount of 5 mass % to 150 mass % based on the amount of the dispersion medium, an emulsifier and a polymerization initiator. Various conditions such as the dispersion medium, the monomer concentration, the amount of initiator, the amount of emulsifier, the amount of dispersant, the reaction temperature, and the method for adding monomers are suitably determined considering the type of the monomers to be used. Furthermore, it is preferable to use a dispersant when necessary.

Generally, the emulsion polymerization method can be conducted according to the disclosures of the following documents: "Gosei Jushi Emarujon (Synthetic Resin Emulsions)" (edited by Taira Okuda and Hiroshi Inagaki and published by Kobunshi Kankokai (1978)); "Gosei Ratekkusu no Oyo (Applications of Synthetic Latexes)" (edited by Takaaki Sugimura, Yasuo Kataoka, Soichi Suzuki, and Keiji Kasahara and published by Kobunshi Kankokai (1993)); and "Gosei Ratekkusu no Kagaku (Chemistry of Synthetic Latexes)" (edited by Soichi Muroi and published by Kobunshi Kankokai (1970)). The emulsion polymerization method for synthesizing the latex polymer for use in the present invention may be a batch polymerization method, a monomer (continuous or divided) addition method, an emulsion addition method, or a seed polymerization method. The emulsion polymerization method is preferably a batch polymerization method, a monomer (continuous or divided) addition method, or an emulsion addition method in view of the productivity of latex.

The polymerization initiator may be any polymerization initiator having radical generating ability. The polymerization initiator to be used may be selected from inorganic peroxides such as persulfates and hydrogen peroxide, peroxides described in the organic peroxide catalogue of NOF Corporation, and azo compounds as described in the azo polymerization initiator catalogue of Wako Pure Chemical Industries, Ltd. Among them, water-soluble peroxides such as persulfates and water-soluble azo compounds as described in the azo polymerization initiator catalogue of Wako Pure Chemical Industries, Ltd. are preferable; ammonium persulfate, sodium persulfate, potassium persulfate, azobis(2-methylpropionamidine) hydrochloride, azobis(2-methyl-N-(2-hydroxyethyl)propionamide), and azobiscyanovaleric acid are more preferable; and peroxides such as ammonium persulfate, sodium persulfate, and potassium persulfate are especially preferable from the viewpoints of image storability, solubility, and cost.

The amount of the polymerization initiator to be added is, based on the total amount of monomers, preferably 0.3 mass % to 2.0 mass %, more preferably 0.4 mass % to 1.75 mass %, and especially preferably 0.5 mass % to 1.5 mass %.

The polymerization emulsifier to be used may be selected from anionic surfactants, nonionic surfactants, cationic surfactants, and ampholytic surfactants. Among them, anionic surfactants are preferable from the viewpoints of dispersibility and image storability. Sulfonic acid type anionic surfactants are more preferable because polymerization stability can be ensured even with a small addition amount and they have resistance to hydrolysis. Long chain alkyldiphenyl ether disulfonic acid salts (whose typical example is PELEX SS-H manufactured by Kao Corporation, trade name) are still more preferable, and low electrolyte types such as PIONIN A-43-S (manufactured by Takemoto Oil & Fat Co., Ltd., trade name) are especially preferable.

The amount of sulfonic acid type anionic surfactant as the polymerization emulsifier is preferably 0.1 mass % to 10.0 mass %, more preferably 0.2 mass % to 7.5 mass %, and especially preferably 0.3 mass % to 5.0 mass %, based on the total amount of monomers.

It is preferable to use a chelating agent in synthesizing the latex polymer to be used in the present invention. The chelating agent is a compound capable of coordinating (chelating) a polyvalent ion such as metal ion (e.g., iron ion) or alkaline earth metal ion (e.g., calcium ion), and examples of the chelate compound which can be used include the compounds described in JP-B-6-8956 ("JP-B" means examined Japanese patent publication), U.S. Pat. No. 5,053,322, JP-A-4-73645, JP-A-4-127145, JP-A-4-247073, JP-A-4-305572, JP-A-6-11805, JP-A-5-173312, JP-A-5-66527, JP-A-5-158195, JP-A-6-118580, JP-A-6-110168, JP-A-6-161054, JP-A-6-175299, JP-A-6-214352, JP-A-7-114161, JP-A-7-114154, JP-A-7-120894, JP-A-7-199433, JP-A-7-306504, JP-A-9-43792, JP-A-8-314090, JP-A-10-182571, JP-A-10-182570, and JP-A-11-190892.

Preferred examples of the chelating agent include inorganic chelate compounds (e.g., sodium tripolyphosphate, sodium hexametaphosphate, sodium tetrapolyphosphate), aminopolycarboxylic acid-based chelate compounds (e.g., nitrilotriacetic acid, ethylenediaminetetraacetic acid), organic phosphonic acid-based chelate compounds (e.g., compounds described in Research Disclosure, No. 18170, JP-A-52-102726, JP-A-53-42730, JP-A-56-97347, JP-A-54-121127, JP-A-55-4024, JP-A-55-4025, JP-A-55-29883, JP-A-55-126241, JP-A-55-65955, JP-A-55-65956, JP-A-57-179843, JP-A-54-61125, and West German Patent No. 1045373), polyphenol-based chelating agents, and polyamine-based chelate compounds, with aminopolycarboxylic acid derivatives being particularly preferred.

Preferred examples of the aminopolycarboxylic acid derivative include the compounds shown in the Table attached to "EDTA (—Complexane no Kagaku—) (EDTA—Chemistry of Complexane—)", Nankodo (1977). In these compounds, a part of the carboxyl groups may be substituted by an alkali metal salt such as sodium or potassium or by an ammonium salt. More preferred examples of the aminopolycarboxylic acid derivative include iminodiacetic acid, N-methyliminodiacetic acid, N-(2-aminoethyl)iminodiacetic acid, N-(carbamoylmethyl)imino diacetic acid, nitrilotriacetic acid, ethylenediamine-N,N'-diacetic acid, ethylenediamine-N,N'-di-α-propionic acid, ethylenediamine-N,N'-di-β-propionic acid, N,N'-ethylene-bis(α-o-hydroxyphenyl)glycine, N,N'-di(2-hydroxybenzyl)ethylenediamine-N,N'-diacetic acid, ethylenediamine-N,N'-diacetic acid-N,N'-diacetohydroxamic acid, N-hydroxyethylethylenediamine-N,N',N'-triacetic acid, ethylenediamine-N,N,N',N'-tetraacetic acid, 1,2-propylenediamine-N,N,N',N'-tetraacetic acid, d,1-2,3-diaminobutane-N,N,N',N'-tetraacetic acid, meso-2,3-diaminobutane-N,N,N',N'-tetraacetic acid, 1-phenylethylenediamine-N,N,N',N'-tetraacetic acid, d,1-1,2-diphenylethylenediamine-N,N,N',N'-tetraacetic acid, 1,4-diaminobutane-N,N,N',N'-tetraacetic acid, trans-cyclobutane-1,2-diamine-N,N,N',N'-tetraacetic acid, trans-cyclopentane-1,2-diamine-N,N,N',N'-tetraacetic acid, trans-cyclohexane-1,2-diamine-N,N,N',N'-tetraacetic acid, cis-cyclohexane-1,2-diamine-N,N,N',N'-tetraacetic acid, cyclohexane-1,3-diamine-N,N,N',N'-tetraacetic acid, cyclohexane-1,4-diamine-N,N,N',N'-tetraacetic acid, o-phenylenediamine-N,N,N',N'-tetraacetic acid, cis-1,4-diaminobutene-N,N,N',N'-tetraacetic acid, trans-1,4-diaminobutene-N,N,N',N'-tetraacetic acid, α,α'-diamino-o-xylene-N,N,N',N'-tetraacetic acid, 2-hydroxy-1,3-propanediamine-N,N,N',N'-tetraacetic acid, 2,2'-oxy-bis(ethyliminodiacetic acid), 2,2'-ethylenedioxy-bis(ethyliminodiacetic acid), ethylenediamine-N,N'-diacetic acid-N,N'-di-α-propionic acid, ethylenediamine-N,N'-diacetic acid-N,N'-di-β-propionic acid, ethylenediamine-N,N,N',N'-tetrapropionic acid, diethylenetriamine-N,N,N',N",N"-pentaacetic acid, triethylenetetramine-N,N,N',N",N'",N'"-hexaacetic acid, and 1,2,3-triaminopropane-N,N,N',N", N''',N'''-hexaacetic acid. In these compounds, a part of the carboxyl groups may be substituted by an alkali metal salt such as sodium or potassium or by an ammonium salt.

The amount of the chelating agent to be added is preferably 0.01 mass % to 0.4 mass %, more preferably 0.02 mass % to 0.3 mass %, and especially preferably 0.03 mass % to 0.15 mass %, based on the total amount of monomers. When the addition amount of the chelating agent is too small, metal ions entering during the preparation of the latex polymer are not sufficiently trapped, and the stability of the latex against aggregation is lowered, whereby the coating properties become worse. When the amount is too large, the viscosity of the latex increases, whereby the coating properties are lowered.

In the preparation of the latex polymer to be used in the present invention, it is preferable to use a chain transfer agent. As the chain transfer agent, ones described in Polymer Handbook (3rd Edition) (Wiley-Interscience, 1989) are preferable. Sulfur compounds are more preferable because they have high chain-transfer ability and because the required amount is small. Especially, hydrophobic mercaptane-based chain transfer agents such as tert-dodecylmercaptane and n-dodecylmercaptane are preferable.

The amount of the chain transfer agent to be added is preferably 0.2 mass % to 2.0 mass %, more preferably 0.3 mass % to 1.8 mass %, and especially preferably 0.4 mass % to 1.6 mass %, based on the total amount of monomers.

Besides the foregoing compounds, in the emulsion polymerization, use can be made of additives, such as electrolytes, stabilizers, thickeners, defoaming agents, antioxidants, vulcanizers, antifreezing agents, gelling agents, and vulcanization accelerators, as described, for example, in Synthetic Rubber Handbook.

In the coating solution of the polymer latex to be used in the present invention, an aqueous solvent can be used as the solvent, and a water-miscible organic solvent may optionally be used in combination. Examples of the water-miscible organic solvent include alcohols (for example, methyl alcohol, ethyl alcohol, and propyl alcohol), cellosolves (for example, methyl cellosolve, ethyl cellosolve, and butyl cellosolve), ethyl acetate, and dimethylformamide. The amount of the organic solvent to be added is preferably 50 mass % or less of the entire solvent, more preferably 30 mass % or less of the entire solvent.

Furthermore, in the polymer latex to be used in the present invention, the polymer concentration is, based on the amount of the latex liquid, preferably 10 mass % to 70 mass %, more preferably 20 mass % to 60 mass %, and especially preferably 30 mass % to 55 mass %.

The amount of the latex polymer to be added is preferably 50 to 95% by mass and more preferably 70 to 90% by mass as its solid content based on all polymers in the receptor layer.

The polymer latex in the image-receiving sheet that can be used in the present invention includes a state of a gel or dried film formed by removing a part of solvents by drying after coating.

In the present invention, it is preferable to use a water-soluble polymer, and the water-soluble polymer can be preferably used in at least one layer selected from the receptor layer(s) and the heat insulation layer(s).

<Water-soluble Polymer>

Herein, the "water-soluble polymer" means a polymer which dissolves, in 100 g water at 20° C., in an amount of preferably 0.05 g or more, more preferably 0.1 g or more, further preferably 0.5 g or more, and particularly preferably 1 g or more. The water-soluble polymer which can be used in the present invention is natural polymers (polysaccharide type, microorganism type, and animal type), semi-synthetic polymers (cellulose-based, starch-based, and alginic acid-based), and synthetic polymer type (vinyl type and others); and synthetic polymers including polyvinyl alcohols, and natural or semi-synthetic polymers using celluloses derived from plant as starting materials, which will be explained later, correspond to the water-soluble polymer usable in the present invention. The latex polymers recited above are not included in the water-soluble polymers which can be used in the present invention.

Among the water-soluble polymers which can be used in the present invention, the natural polymers and the semi-synthetic polymers will be explained in detail. Specific examples include the following polymers: plant type polysaccharides such as gum arabics, κ-carrageenans, ι-carrageenans, λ-carrageenans, guar gums (e.g. Supercol, manufactured by Squalon), locust bean gums, pectins, tragacanths, corn starches (e.g. Purity-21, manufactured by National Starch & Chemical Co.), and phosphorylated starches (e.g. National 78-1898, manufactured by National Starch & Chemical Co.); microbial type polysaccharides such as xanthan gums (e.g. Keltrol T, manufactured by Kelco) and dextrins (e.g. Nadex 360, manufactured by National Starch & Chemical Co.); animal type natural polymers such as gelatins (e.g. Crodyne B419, manufactured by Croda), caseins, sodium chondroitin sulfates (e.g. Cromoist CS, manufactured by Croda); cellulose-based polymers such as ethylcelluloses (e.g. Cellofas WLD, manufactured by I.C.I.), carboxymethylcelluloses (e.g. CMC, manufactured by Daicel), hydroxyethylcelluloses (e.g. HEC, manufactured by Daicel), hydroxypropylcelluloses (e.g. Klucel, manufactured by Aqualon), methylcelluloses (e.g. Viscontran, manufactured by Henkel), nitrocelluloses (e.g. Isopropyl Wet manufactured by Hercules), and cationated celluloses (e.g. Crodacel QM, manufactured by Croda); starches such as phosphorylated starches (e.g. National 78-1898, manufactured by National Starch & Chemical Co.); alginic acid-based compounds such as sodium alginates (e.g. Keltone, manufactured by Kelco) and propylene glycol alginates; and other polymers such as cationated guar gums (e.g. Hi-care 1000, manufactured by Alcolac) and sodium hyaluronates (e.g. Hyalure, manufactured by Lifecare Biomedial) (all of the names are trade names).

Among the water-soluble polymers which can be used in the present invention, the synthetic polymers will be explained in detail. Examples of the acryl type include sodium polyacrylates, polyacrylic acid copolymers, polyacrylamides, polyacrylamide copolymers, and polydiethylaminoethyl(meth)acrylate quaternary salts or their copolymers. Examples of the vinyl type include polyvinylpyrrolidones, polyvinylpyrrolidone copolymers, and polyvinyl alcohols. Examples of the others include polyethylene glycols, polypropylene glycols, polyisopropylacrylamides, polymethyl vinyl ethers, polyethyleneimines, polystyrenesulfonic acids or their copolymers, naphthalenesulfonic acid condensate salts, polyvinylsulfonic acids or their copolymers, polyacrylic acids or their copolymers, acrylic acid or its copolymers, maleic acid copolymers, maleic acid monoester copolymers, acryloylmethylpropanesulfonic acid or its copolymers, polydimethyldiallylammonium chlorides or their copolymers, polyamidines or their copolymers, polyimidazolines, dicyanamide type condensates, epichlorohydrin/dimethylamine condensates, Hofmann decomposed products of polyacrylamides, and water-soluble polyesters (Plascoat Z-221, Z-446, Z-561, Z-450, Z-565, Z-850, Z-3308, RZ-105, RZ-570, Z-730 and RZ-142 (all of these names are trade names), manufactured by Goo Chemical Co., Ltd.).

In addition, highly-water-absorptive polymers, namely, homopolymers of vinyl monomers having —COOM or —$SO_3M$ (M represents a hydrogen atom or an alkali metal) or copolymers of these vinyl monomers among them or with other vinyl monomers (for example, sodium methacrylate, ammonium methacrylate, Sumikagel L-5H (trade name) manufactured by Sumitomo Chemical Co., Ltd.) as described in, for example, U.S. Pat. No. 4,960,681 and JP-A-62-245260, may also be used.

Of the water-soluble synthetic polymers usable in the present invention, the polyvinyl alcohols are explained in further detail.

Examples of completely saponificated polyvinyl alcohol include PVA-105 [polyvinyl alcohol (PVA) content: 94.0 mass % or more; degree of saponification: 98.5±0.5 mol %; content of sodium acetate: 1.5 mass % or less; volatile constituent: 5.0 mass % or less; viscosity (4 mass %; 20° C.): 5.6±0.4 CPS]; PVA-110 [PVA content: 94.0 mass %; degree of saponification: 98.5±0.5 mol %; content of sodium acetate: 1.5 mass %; volatile constituent: 5.0 mass %; viscosity (4 mass %; 20° C.): 11.0±0.8 CPS]; PVA-117 [PVA content: 94.0 mass %; degree of saponification: 98.5±0.5 mol %; content of sodium acetate: 1.0 mass %; volatile constituent: 5.0 mass %; viscosity (4 mass %; 20° C.): 28.0±3.0 CPS]; PVA-117H [PVA content: 93.5 mass %; degree of saponification: 99.6±0.3 mol %; content of sodium acetate: 1.85 mass %; volatile constituent: 5.0 mass %; viscosity (4 mass %; 20° C.): 29.0±3.0 CPS]; PVA-120 [PVA content: 94.0 mass %; degree of saponification: 98.5±0.5 mol %; content of sodium acetate: 1.0 mass %; volatile constituent: 5.0 mass %; viscosity (4 mass %; 20° C.): 39.5±4.5 CPS]; PVA-124 [PVA content: 94.0 mass %; degree of saponification: 98.5±0.5 mol %; content of sodium acetate: 1.0 mass %; volatile constituent: 5.0 mass %; viscosity (4 mass %; 20° C.): 60.0±6.0 CPS]; PVA-124H [PVA content: 93.5 mass %; degree of saponification: 99.6±0.3 mol %; content of sodium acetate: 1.85 mass %; volatile constituent: 5.0 mass %; viscosity (4 mass %; 20° C.): 61.0±6.0 CPS]; PVA-CS [PVA content: 94.0 mass %; degree of saponification: 97.5±0.5 mol %; content of sodium acetate: 10.0 mass %; volatile constituent: 5.0 mass %; viscosity (4 mass %; 20° C.): 27.5±3.0 CPS]; PVA-CST [PVA content: 94.0 mass %; degree of saponification: 96.0±0.5 mol %; content of sodium acetate: 1:0 mass %; volatile constituent: 5.0 mass %; viscosity (4 mass %; 20° C.): 27.0±3.0 CPS]; and PVA-HC [PVA content: 90.0 mass %; degree of saponification: 99.85 mol % or more; content of sodium acetate: 2.5 mass %; volatile constituent: 8.5 mass %; viscosity (4 mass %; 20° C.): 25.0±3.5 CPS] (all trade names, manufactured by Kuraray Co., Ltd.), and the like.

Examples of partially saponificated polyvinyl alcohol include PVA-203 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.4±0.2 CPS]; PVA-204 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.9±0.3 CPS]; PVA-205 [PVA content: 94.0 mass %; degree of saponification: 88.0±1.5 mol %; content of sodium acetate: 1.0 mass %; volatile constituent: 5.0 mass %; viscosity (4 mass %; 20° C.): 5.0±0.4 CPS]; PVA-210 [PVA content: 94.0 mass %; degree of saponification: 88.0±1.0 mol %; content of sodium acetate: 1.0 mass %; volatile constituent: 5.0 mass %; viscosity (4 mass %; 20° C.): 9.0±1.0 CPS]; PVA-217 [PVA content: 94.0 mass %; degree of saponification: 88.0±1.0 mol %; content of sodium acetate: 1.0 mass %; volatile constituent: 5.0 mass %; viscosity (4 mass %; 20° C.): 22.5±2.0 CPS]; PVA-220 [PVA content: 94.0 mass %; degree of saponification: 88.0±1.0 mol %; content of sodium acetate: 1.0 mass %; volatile constituent: 5.0 mass %; viscosity (4 mass %; 20° C.): 30.0±3.0 CPS]; PVA-224 [PVA content: 94.0 mass %; degree of saponification: 88.0±1.5 mol %; content of sodium acetate: 1.0 mass %; volatile constituent: 5.0 mass %; viscosity (4 mass %; 20° C.): 44.0±4.0 CPS]; PVA-228 [PVA content: 94.0 mass %; degree of saponification: 88.0±1.5 mol %; content of sodium acetate: 1.0 mass %; volatile constituent: 5.0 mass %; viscosity (4 mass %; 20° C.): 65.0±5.0 CPS]; PVA-235 [PVA content: 94.0 mass %; degree of saponification: 88.0±1.5 mol %; content of sodium acetate: 1.0 mass %; volatile constituent: 5.0 mass %; viscosity (4 mass %; 20° C.): 95.0±15.0 CPS]; PVA-217EE [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-217E [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-220E [PVA content: 94.0 mass %; degree of saponification: 88.0±1.0 mol %; content of sodium acetate: 1.0 mass %; volatile constituent: 5.0 mass %; viscosity (4 mass %; 20° C.): 31.0±4.0 CPS]; PVA-224E [PVA content: 94.0 mass %; degree of saponification: 88.0±1.0 mol %; content of sodium acetate: 1.0 mass %; volatile constituent: 5.0 mass %; viscosity (4 mass %; 20° C.): 45.0±5.0 CPS]; PVA-403 [PVA content: 94.0 mass %; degree of saponification: 80.0±1.5 mol %; content of sodium acetate: 1.0 mass %; volatile constituent: 5.0 mass %; viscosity (4 mass %; 20° C.): 3.1±0.3 CPS]; PVA-405 [PVA content: 94.0 mass %; degree of saponification: 81.5±1.5 mol %; content of sodium acetate: 1.0 mass %; volatile constituent: 5.0 mass %; viscosity (4 mass %; 20° C.): 4.8±0.4 CPS]; PVA-420 [PVA content: 94.0 mass %; degree of saponification: 79.5±1.5 mol %; content of sodium acetate: 1.0 mass %; volatile constituent: 5.0 mass %]; PVA-613 [PVA content: 94.0 mass %; degree of saponification: 93.5±1.0 mol %; content of sodium acetate: 1.0 mass %; volatile constituent: 5.0 mass %; viscosity (4 mass %; 20° C.): 16.5±2.0 CPS]; L-8 [PVA content: 96.0 mass %; degree of saponification: 71.0±1.5 mol %; content of sodium acetate: 1.0 mass % (ash); volatile constituent: 3.0 mass %; viscosity (4 mass %; 20° C.): 5.4±0.4 CPS] (all trade names, manufactured by Kuraray Co., Ltd.), and the like.

The above values were measured in the manner described in JIS K-6726-1977.

With respect to modified polyvinyl alcohols, those described in Koichi Nagano, et al., "Poval", Kobunshi Kankokai, Inc. are useful. The modified polyvinyl alcohols include polyvinyl alcohols modified by cations, anions, —SH compounds, alkylthio compounds, or silanols.

Examples of such modified polyvinyl alcohols (modified PVA) include C polymers such as C-118, C-318, C-318-2A, and C-506 (all being trade names of Kuraray Co., Ltd.); HL polymers such as HL-12E and HL-1203 (all being trade names of Kuraray Co., Ltd.); HM polymers such as HM-03 and HM-N-03 (all being trade names of Kuraray Co., Ltd.); K polymers such as KL-118, KL-318, KL-506, KM-118T, and KM-618 (all being trade names of Kuraray Co., Ltd.); M polymers such as M-115 (a trade name of Kuraray co., Ltd.); MP polymers such as MP-102, MP-202, and MP-203 (all being trade names of Kuraray Co., Ltd.); MPK polymers such as MPK-1, MPK-2, MPK-3, MPK-4, MPK-5, and MPK-6 (all being trade names of Kuraray Co., Ltd.); R polymers such as R-1130, R-2105, and R-2130 (all being trade names of Kuraray Co., Ltd.); and V polymers such as V-2250 (a trade name of Kuraray Co., Ltd.).

The viscosity of polyvinyl alcohol can be adjusted or stabilized by adding a trace amount of a solvent or an inorganic salt to an aqueous solution of polyvinyl alcohol, and there can be employed compounds described in the aforementioned reference "Poval", Koichi Nagano et al., published by Kobunshi Kankokai, pp. 144-154. For example, a coated surface quality can be improved by an addition of boric acid. The amount of boric acid to be added is preferably 0.01 to 40 mass %, with respect to polyvinyl alcohol.

Preferred binders are transparent or semitransparent, generally colorless, and water-soluble. Examples include natural resins, polymers and copolymers; synthetic resins, polymers, and copolymers; and other media that form films: for example, rubbers, polyvinyl alcohols, hydroxyethyl celluloses, cellulose acetates, cellulose acetate butylates, polyvinylpyrrolidones, starches, polyacrylic acids, polymethyl methacrylates, polyvinyl chlorides, polymethacrylic acids, styrene/maleic acid anhydride copolymers, styrene/acrylonitrile copolymers, styrene/butadiene copolymers, polyvinylacetals (e.g., polyvinylformals and polyvinylbutyrals), polyesters, polyurethanes, phenoxy resins, polyvinylidene chlorides, polyepoxides, polycarbonates, polyvinyl acetates, polyolefins, cellulose esters, and polyamides.

In the present invention, preferred water-soluble polymers are polyvinyl alcohols and gelatin, with gelatin being most preferred.

The amount of the water-soluble polymer is preferably 50 mass % or less, more preferably 30 mass % or less, still more preferably 0.005 to 10 mass % and particularly preferably 0.5 to 5 mass % in total polymers contained in the receptor layer.

<Releasing Agent>

It is also possible to blend a releasing agent in the receptor layer, to prevent sticking due to welding of the heat-sensitive transfer image-receiving sheet and the heat-sensitive transfer sheet at the time of image formation. As the releasing agent, any of silicone oils, phosphoric acid ester-based plasticizers, fluorine-containing compounds, and wax emulsions can be used, and wax emulsions can be used particularly preferably. Wax emulsions that can be used in the invention are prepared by emulsification of waxes. Examples of waxes undergoing emulsification include paraffin wax, candelilla wax, carnauba wax, rice wax, ceresin wax, petrolatum, Fischer-Tropsch wax, polyethylene wax, montan wax and derivatives thereof, microcrystalline wax and derivatives thereof, hydrogenated castor oil, liquid paraffin, and stearic acid amides. Of these waxes, paraffin wax is particularly preferable for use in the present invention. Emulsions of such waxes may be prepared in usual manners. For instance, a wax, a resin and a fluidizing agent are mixed and molten by heating, and admixed with an emulsifier, thereby performing emulsification. Examples of the resin usable therein include polyhydric alcohols, and esterification products of polyhydric alcohol. To such a molten mixture, for example, an anionic, cationic or nonionic surfactant, a basic compound such as ammonia, sodium hydroxide or potassium hydroxide, an organic amine, or a styrene/maleic acid copolymer is/are added to cause emulsification, and thereby a wax emulsion can be prepared. The addition amount of releasing agent is preferably from 0.2 to 30 parts by mass, per 100 parts by mass of dye (colorant)-receptor polymer (e.g. a latex polymer).

<Crosslinking Agent>

The receptor layer and/or the heat insulation layer preferably contain(s) a crosslinking agent (compound capable of crosslinking a water-soluble polymer). It is preferable that the above-mentioned water-soluble polymer contained in the receptor layer (and/or in the heat insulation layer) is partly or entirely crosslinked with the crosslinking agent.

The crosslinking agent is required to have a plurality of groups capable of reacting with an amino group, a carboxyl group, a hydroxyl group or the like, but the agent to be used may be suitably selected depending on the kind of the water-soluble polymer. Thus, there is no particular limitation for the kind of the crosslinking agent. It is suitable to use any of methods described in T. H. James; "THE THEORY OF THE PHOTOGRAPHIC PROCESS FOURTH EDITION", published by Macmillan Publishing Co., Inc. (1977), pp. 77 to 87, and crosslinking agents described in, for example, U.S. Pat. No. 4,678,739, col. 41; JP-A-59-116655, JP-A-62-245261, and JP-A-61-18942. Both crosslinking agents of an inorganic compound (e.g., chrome alum, boric acid and salts thereof) and crosslinking agents of an organic compound may be preferably used. Alternatively, the crosslinking agent to be used may be a mixture solution containing a chelating agent and a zirconium compound, whose pH is in the range of 1 to 7, as described in JP-A-2003-231775.

Specific examples of the crosslinking agent include epoxy-series compounds (e.g., diglycidyl ethyl ether, ethyleneglycol diglycidyl ether, 1,4-butanediol diglycidyl ether, 1,6-diglycidyl cyclohexane, N,N-diglycidyl-4-glycidyloxyaniline, sorbitol polyglycidyl ether, glycerol polyglycidyl ether, compounds described in JP-A-6-329877, JP-A-7-309954 and the like, and DIC FINE EM-60 (trade name, manufactured by DAINIPPON INK AND CHEMICALS, INCORPORATED)), aldehyde-series compounds (e.g., formaldehyde, glyoxal, glutalaldehyde), active halogen-containing compounds (e.g., 2,4-dichloro-4-hydroxy-1,3,5-s-triazine, and compounds described in U.S. Pat. No. 3,325,287 and the like), active vinyl-series compounds (e.g., 1,3,5-trisacryloyl-hexahydro-s-triazine, bisvinylsulfonylmethyl ether, N,N'-ethylene-bis(vinylsulfonylactamido)ethane, and compounds described in JP-B-53-41220, JP-B-53-57257, JP-B-59-162546, JP-B-60-80846 and the like), mucohalogen acid compounds (e.g., mucochloric acid), N-carbamoylpyridinium salt compounds (e.g., (1-morpholinocarbonyl-3-pyridinio)methanesulfonate), haloamidinium salt compounds (e.g., 1-(1-chloro-1-pyridinomethylene)pyrrolidinium, 2-naphthalenesulfonate), N-methylol-series compounds (e.g., dimethylolurea, methyloldimethylhydantoin), carbodiimido compounds (e.g., polycarbodiimido compounds derived from isoholondiisocyanate as described in JP-A-59-187029 and JP-B-5-27450, carbodiimido compounds derived from tetramethylxylylene diisocyanate as described in JP-A-7-330849, multi-branch type carbodiimido compounds described in JP-A-10-30024, carbodiimido compounds derived from dicyclohexylmethane diisocyanate as described in JP-A-2000-7642, and CARBODILITE V-02, V-02-L2, V-04, V-06, E-01 and E-02 (trade names, manufactured by Nisshinbo Industries, Inc.)), oxazoline compounds (e.g., oxazoline compounds described in JP-A-2001-215653 and EPOCROS K-1010E, K-1020E, K-1030E, K-2010E, K-2020E, K-2030E, WS-500 and WS-700 (trade names, manufactured by NIPPON SHOKUBAI CO., LTD.)), isocyanate compounds (e.g., dispersible isocyanate compounds described in JP-A-7-304841, JP-A-8-277315, JP-A-10-45866, JP-A-9-71720, JP-A-9-328654, JP-A-9-104814, JP-A-2000-194045, JP-A-2000-194237 and JP-A-2003-64149, and Duranate WB40-100, WB40-80D, WT20-100 and WT30-100 (trade names, manufactured by Asahi Kasei Corporation), CR-60N (trade name, manufactured by DAINIPPON INK AND CHEMICALS, INCORPORATED)), polymer (high molecular) hardeners (e.g., compounds described in JP-A-62-234157 and the like); boric acid and salts thereof, borax, and alum.

Preferable compounds as the crosslinking agent include epoxy-series compounds, aldehyde-series compounds, active halogen-containing compounds, active vinyl-series compounds, N-carbamoylpyridinium salt compounds, N-methylol-series compounds (e.g., dimethylolurea, methyloldimethylhydantoin), carbodiimido compounds, oxazoline compounds, isocyanate compounds, polymer hardeners (e.g., compounds described in JP-A-62-234157 and the like), boric acid and salts thereof, borax, and alum. More preferable crosslinking agent include epoxy-series compounds, active halogen-containing compounds, active vinyl-series compounds, N-carbamoylpyridinium salt compounds, N-methylol-series compounds (e.g., dimethylolurea, methyloldimethylhydantoin), polymer hardeners (e.g., compounds described in JP-A-62-234157 and the like) and boric acid.

The above-mentioned crosslinking agent may be used singly or in combination of two or more.

The crosslinking agent that can be used in the present invention may be added to the water-soluble polymer solution in advance, or may be added at the last step for the preparation of the coating solution. Alternatively, the crosslinking agent may be added just before the coating.

The water-soluble polymer in the receptor layer is preferably cross-linked in a ratio of from 0.1 to 20 mass %, more preferably from 1 to 10 mass %, among the entire water-soluble polymer, even though the ratio varies depending on the kind of the crosslinking agent.

The addition amount of the crosslinking agent that can be used in the present invention varies depending on the kinds of the water-soluble binder and the crosslinking agent, but it is preferable that the amount is approximately in the range of from 0.1 to 50 mass parts, more preferably from 0.5 to 20 mass parts, and further more preferably from 1 to 10 mass parts, based on 100 mass parts of the water-soluble polymer contained in the constituting layer.

<Emulsion>

Hydrophobic additives, such as a lubricant, an antioxidant, and the like, can be introduced into a layer of the image-receiving sheet (e.g. the receptor layer, the heat insulation layer, the undercoat layer), by using a known method described in U.S. Pat. No. 2,322,027, or the like. In this case, a high-boiling organic solvent, as described in U.S. Pat. No. 4,555,470, No. 4,536,466, No. 4,536,467, No. 4,587,206, No. 4,555,476 and No. 4,599,296, JP-B-3-62256, and the like, may be used singly or in combination with a low-boiling organic solvent having a boiling point of 50 to 160° C., according to the need. Also, these lubricants, antioxidants, and high-boiling organic solvents may be respectively used in combination of two or more.

As the antioxidant (hereinafter, also referred to as a radical trapper in this specification), a compound represented by any one of the following formulae (E-1) to (E-3) is preferably used.

Formula (E-1)

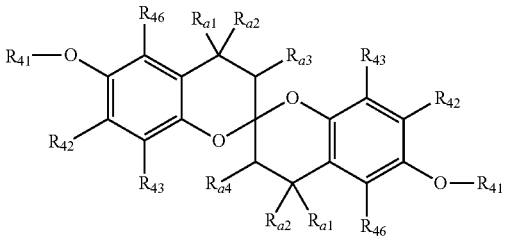

-continued

Formula (E-2)

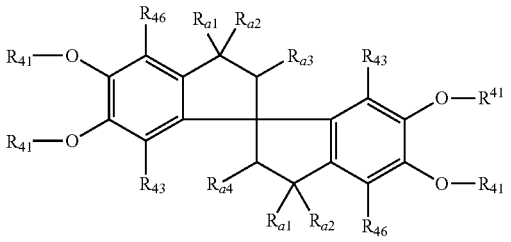

Formula (E-3)

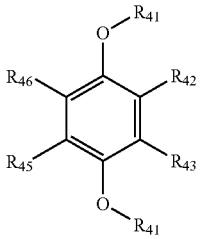

$R_{41}$ represents an aliphatic group, an aryl group, a heterocyclic group, an acyl group, an aliphatic oxycarbonyl group, an aryloxycarbonyl group, an aliphatic sulfonyl group, an arylsulfonyl group, a phosphoryl group, or a group —Si($R_{47}$)($R_{48}$)($R_{49}$) in which $R_{47}$, $R_{48}$ and $R_{49}$ each independently represent an aliphatic group, an aryl group, an aliphatic oxy group, or an aryloxy group. $R_{42}$, to $R_{46}$ each independently represent a hydrogen atom, or a substituent. Further, examples of the substituent include those of $R^{51}$ in formula (7), as described below. $R_{a1}$, $R_{a2}$, $R_{a3}$, and $R_{a4}$ each independently represent a hydrogen atom, or an aliphatic group (for example, methyl, ethyl).

With respect to the compounds represented by any one of the Formulae (E-1) to (E-3), the groups that are preferred from the viewpoint of the effect to be obtained by the present invention, are explained below.

In the Formulae (E-1) to (E-3), it is preferred that $R_{41}$ represent an aliphatic group, an acyl group, an aliphatic oxycarbonyl group, an aryloxycarbonyl group, or a phosphoryl group, and $R_{42}$, $R_{43}$, $R_{45}$, and $R_{46}$ each independently represent a hydrogen atom, an aliphatic group, an aliphatic oxy group, or an acylamino group. It is more preferred that $R_4$, represent an aliphatic group, and $R_{42}$, $R_{43}$, $R_{45}$ and $R_{46}$ each independently represent a hydrogen atom or an aliphatic group.

Preferable specific examples of the compounds represented by any one of the Formulae (E-1) to (E-3) are shown below, but the present invention is not limited to these compounds.

EB-1

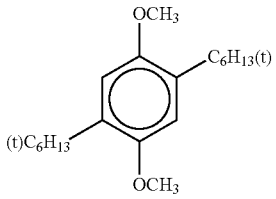

-continued

EB-2

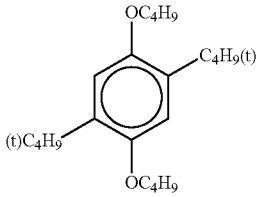

EB-3

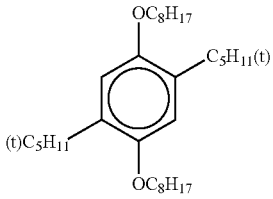

EB-4

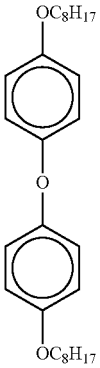

EB-5

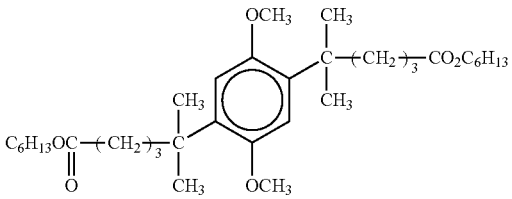

EB-6

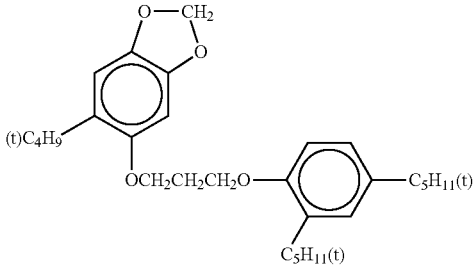

EB-7

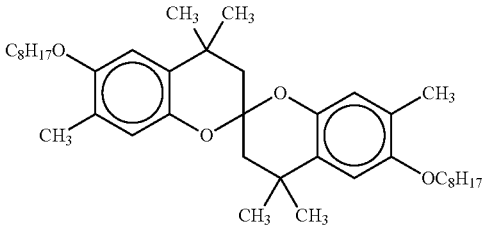

-continued

EB-8

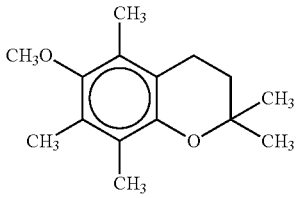

EB-9

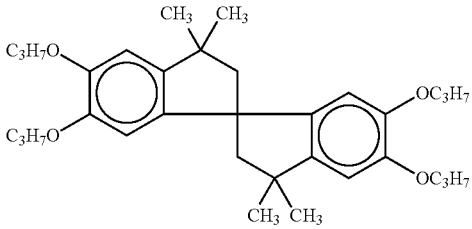

EB-10

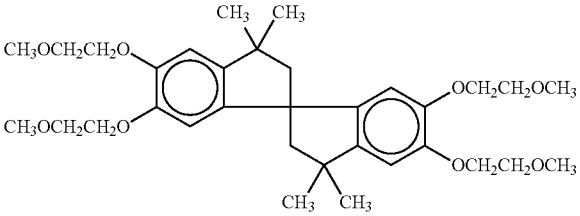

EB-11

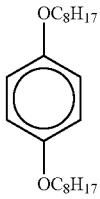

A content of the antioxidant is preferably from 1.0 to 10 mass %, based on a solid content in the polymer latex.

As the lubricant, solid waxes such as polyethylene wax, amide wax and Teflon® powder; silicone oil, phosphate-series compounds, fluorine-based surfactants, silicone-based surfactants and others including releasing agents known in the technical fields concerned may be used. Fluorine-containing compounds typified by fluorine-based surfactants, silicone-based surfactants and silicone-series compounds such as silicone oil and/or hardened products thereof are preferably used. A content of the lubricant is preferably from 1.0 to 10 mass %, based on a solid content in the polymer latex.

As the silicone oil as the lubricant, straight silicone oil and modified silicone oil or their hardened products may be used.

Examples of the straight silicone oil include dimethylsilicone oil, methylphenylsilicone oil and methyl hydrogen silicone oil. Examples of the dimethylsilicone oil include KF96-10, KF96-100, KF96-1000, KF96H-10000, KF96H-12500 and KF96H-100000 (all of these names are trade names, manufactured by Shin-Etsu Chemical Co., Ltd.). Examples of the methylphenylsilicone oil include KF50-100, KF54 and KF56 (all of these names are trade names, manufactured by Shin-Etsu Chemical Co., Ltd.).

The modified silicone oil may be classified into reactive silicone oils and non-reactive silicone oils. Examples of the reactive silicone oils include amino-modified, epoxy-modified, carboxyl-modified, hydroxy-modified, methacryl-modified, mercapto-modified, phenol-modified or one-terminal reactive/hetero-functional group-modified silicone oils.

Examples of the amino-modified silicone oil include KF-393, KF-857, KF-858, X-22-3680, X-22-3801C, KF-8010, X-22-161A and KF-8012 (all of these names are trade names, manufactured by Shin-Etsu Chemical Co., Ltd.). Examples of the epoxy-modified silicone oil include KF-100T, KF-101, KF-60-164, KF-103, X-22-343 and X-22-3000T (all of these names are trade names, manufactured by Shin-Etsu Chemical Co., Ltd.). Examples of the carboxyl-modified silicone oil include X-22-162C (trade name, manufactured by Shin-Etsu Chemical Co., Ltd.). Examples of the hydroxy-modified silicone oil include X-22-160AS, KF-6001, KF-6002, KF-6003, X-22-170DX, X-22-176DX, X-22-176D and X-22-176DF (all of these names are trade names, manufactured by Shin-Etsu Chemical Co., Ltd.). Examples of the methacryl-modified silicone oil include X-22-164A, X-22-164C, X-24-8201, X-22-174D and X-22-2426 (all of these names are trade names, manufactured by Shin-Etsu Chemical Co., Ltd.).

Reactive silicone oils may be hardened upon use, and may be classified into a reaction-curable type, photocurable type and catalyst-curable type. Among these types, silicone oil that is the reaction-curable type is particularly preferable. As the reaction-curable type silicone oil, products obtained by reacting an amino-modified silicone oil with an epoxy-modified silicone oil and then by curing are preferable. Also, examples of the catalyst-curable type or photocurable type silicone oil include KS-705F-PS, KS-705F-PS-1 and KS-770-PL-3 (all of these names are trade names, catalyst-curable silicone oils, manufactured by Shin-Etsu Chemical Co., Ltd.) and KS-720 and KS-774-PL-3 (all of these names are trade names, photocurable silicone oils, manufactured by Shin-Etsu Chemical Co., Ltd.). The addition amount of the curable type silicone oil is preferably 0.5 to 30% by mass based on the resin constituting the receptor layer.

Examples of the non-reactive silicone oil include polyether-modified, methylstyryl-modified, alkyl-modified, higher fatty acid ester-modified, hydrophilic special-modified, higher alkoxy-modified or fluorine-modified silicone oils. Examples of the polyether-modified silicone oil include KF-6012 (trade name, manufactured by Shin-Etsu Chemical Co., Ltd.) and examples of the methylstyryl-modified silicone oil include 24-510 and KF41-410 (all of these names are trade names, manufactured by Shin-Etsu Chemical Co., Ltd.). Modified silicones represented by any one of the following formulae 1 to 3 may also be used.

Formula 1

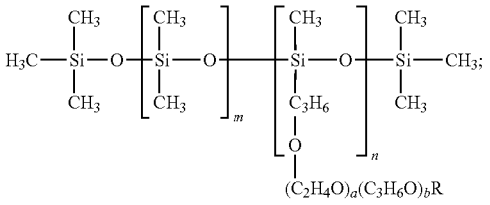

In formula 1, R represents a hydrogen atom or a straight-chain or branched alkyl group which may be substituted with an aryl or cycloalkyl group. m and n respectively denote an integer of 2,000 or less, and a and b respectively denote an integer of 30 or less.

Formula 2

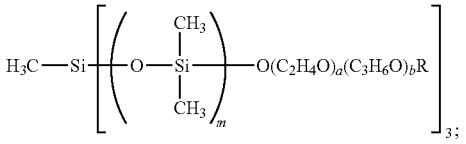

In formula 2, R represents a hydrogen atom or a straight-chain or branched alkyl group which may be substituted with an aryl or cycloalkyl group. m denotes an integer of 2,000 or less, and a and b respectively denote an integer of 30 or less.

Formula 3

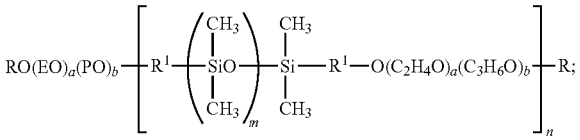

In formula 3, R represents a hydrogen atom or a straight-chain or branched alkyl group which may be substituted with an aryl or cycloalkyl group. m and n respectively denote an integer of 2,000 or less, and a and b respectively denote an integer of 30 or less. $R^1$ represents a single bond or a divalent linking group, E represents an ethylene group which may be further substituted, and P represents a propylene group which may be further substituted.

Silicone oils such as those mentioned above are described in "SILICONE HANDBOOK" (The Nikkan Kogyo Shimbun, Ltd.) and the technologies described in each publication of JP-A-8-108636 and JP-A-2002-264543 may be preferably used as the technologies to cure the curable type silicone oils.

Examples of the high-boiling organic solvent include phthalates (e.g., dibutyl phthalate, dioctyl phthalate, di-2-ethylhexyl phthalate), phosphates or phosphonates (e.g., triphenyl phosphate, tricresyl phosphate, tri-2-ethylhexyl phosphate), fatty acid esters (e.g., di-2-ethylhexyl succinate, tributyl citrate), benzoates (e.g., 2-ethylhexyl benzoate, dodecyl benzoate), amides (e.g., N,N-diethyldodecane amide, N,N-dimethylolein amide), alcohols or phenols (e.g., isostearyl alcohol, 2,4-di-tert-amyl phenol), anilines (e.g., N,N-dibutyl-2-butoxy-5-tert-octylaniline), chlorinated paraffins, hydrocarbons (e.g., dodecyl benzene, diisopropyl naphthalene), and carboxylic acids (e.g., 2-(2,4-di-tert-amyl phenoxy)butyrate).

Preferably the compounds shown below are used.

(Solv-1)

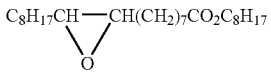

(Solv-2)

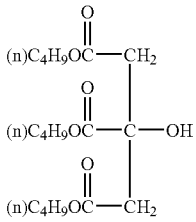

-continued (Solv-3)

$C_4H_9OC(=O)(CH_2)_8C(=O)OC_4H_9$ (Solv-4)

$O{=}P(OC_6H_{13}(n))_3$ (Solv-5)

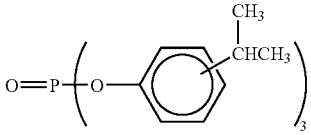

(Solv-6)

$C_8H_{17}CH{=}CHC_8H_{16}OH$ (Solv-7)

$C_8H_{17}OC(=O)(CH_2)_8C(=O)OC_8H_{17}$ (Solv-8)

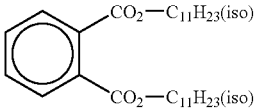

(Solv-9)

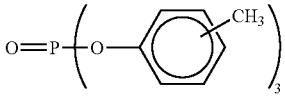

Further, the high-boiling organic solvent may be used in combination with, as an auxiliary solvent, an organic solvent having a boiling point of 30° C. or more and 160° C. or less, such as ethyl acetate, butyl acetate, methyl ethyl ketone, cyclohexanone, methylcellosolve acetate, or the like. The high-boiling organic solvent is used in an amount of generally 10 g or less, preferably 5 g or less, and more preferably 1 to 0.1 g, per 1 g of the hydrophobic additives to be used. The amount is also preferably 1 ml or less, more preferably 0.5 ml or less, and particularly preferably 0.3 ml or less, per 1 g of the binder.

A dispersion method that uses a polymer, as described in JP-B-51-39853 and JP-A-51-59943, and a method wherein the addition is made with them in the form of a dispersion of fine particles, as described in, for example, JP-A-62-30242, can also be used. In the case of a compound that is substantially insoluble in water, other than the above methods, a method can be used wherein the compound is dispersed and contained in the form of a fine particle in a binder.

When the hydrophobic compound is dispersed in a hydrophilic colloid, various surfactants may be used. For example, those listed as examples of the surfactant in JP-A-59-157636, page (37) to page (38) may be used. It is also possible to use phosphates-based surfactants described in JP-A-7-56267, JP-A-7-228589, and West German Patent Application Laid-Open (OLS) No. 1,932,299A.

<Ultraviolet Absorber>

Also, in the present invention, in order to improve light resistance, an ultraviolet absorber may be added to the receptor layer. In this case, when this ultraviolet absorber is made to have a higher molecular weight, it can be secured to the receptor layer so that it can be prevented, for instance, from being diffused into the ink sheet and from being sublimated and vaporized by heating.

As the ultraviolet absorber, compounds having various ultraviolet absorber skeletons, which are widely used in the field of information recording, may be used. Specific examples of the ultraviolet absorber may include compounds having a 2-hydroxybenzotriazole type ultraviolet absorber skeleton, 2-hydroxybenzotriazine type ultraviolet absorber skeleton, or 2-hydroxybenzophenon type ultraviolet absorber skeleton. Compounds having a benzotriazole-type or triazine-type skeleton are preferable from the viewpoint of ultraviolet absorbing ability (absorption coefficient) and stability, and compounds having a benzotriazole-type or benzophenone-type skeleton are preferable from the viewpoint of obtaining a higher-molecular weight and using in a form of a latex. Specifically, ultraviolet absorbers described in, for example, JP-A-2004-361936 may be used.

The ultraviolet absorber preferably absorbs light at wavelengths in the ultraviolet region, and the absorption edge of the absorption of the ultraviolet absorber is preferably outside of the visible region. Specifically, when it is added to the receptor layer to form a heat-sensitive transfer image-receiving sheet, the heat-sensitive transfer image-receiving sheet has a reflection density of, preferably, Abs 0.5 or more at 370 nm, and more preferably Abs 0.5 or more at 380 nm. Also, the heat-sensitive transfer image-receiving sheet has a reflection density of, preferably, Abs 0.1 or less at 400 nm. If the reflection density at a wavelength range exceeding 400 nm is high, it is not preferable because an image is made yellowish.

In the present invention, the ultraviolet absorber is preferably made to have a higher molecular weight. The ultraviolet absorber has a mass average molecular weight of preferably 10,000 or more, and more preferably 100,000 or more. As a means of obtaining a higher-molecular weight ultraviolet absorber, it is preferable to graft an ultraviolet absorber on a polymer. The polymer as the principal chain preferably has a polymer skeleton less capable of being dyed than the receptor polymer to be used together. Also, when the polymer is used to form a film, the film preferably has sufficient film strength. The graft ratio of the ultraviolet absorber to the polymer principal chain is preferably 5 to 20% by mass and more preferably 8 to 15% by mass.

Also, it is more preferable that the ultraviolet-absorber-grafted polymer is made to be used in a form of a latex. When the polymer is made to be used in a form of a latex, an aqueous dispersion-system coating solution may be used in application and coating to form the receptor layer, and this enables reduction of production cost. As a method of making the latex polymer (or making the polymer latex-wise), a method described in, for example, Japanese Patent No. 3,450,339 may be used. As the ultraviolet absorber to be used in a form of a latex, the following commercially available ultraviolet absorbers may be used which include ULS-700, ULS-1700, ULS-1383MA, ULS-1635 MH, XL-7016, ULS-933LP, and ULS-935LH, manufactured by Ipposha Oil Industries Co., Ltd.; and New Coat UVA-1025W, New Coat UVA-204W, and New Coat UVA-4512M, manufactured by Shin-Nakamura Chemical Co., Ltd. (all of these names are trade names).

In the case of using an ultraviolet-absorber-grafted polymer in a form of a latex, it may be mixed with a latex of the receptor polymer capable of being dyed, and the resulting mixture is coated. By doing so, a receptor layer, in which the ultraviolet absorber is homogeneously dispersed, can be formed.

The addition amount of the ultraviolet-absorber-grafted polymer or its latex is preferably 5 to 50 parts by mass, and more preferably 10 to 30 parts by mass, to 100 parts by mass of the receptor polymer latex capable of being dyed to be used to form the receptor layer.

(Heat Insulation Layer)

A heat insulation layer serves to protect the support from heat when a thermal head or the like is used to carry out a transfer operation under heating. Also, because the heat insulation layer has high cushion characteristics, a heat-sensitive transfer image-receiving sheet having high printing sensitivity can be obtained even in the case of using paper as a substrate (support). The heat insulation layer may be a single layer, or multi-layers. The heat insulation layer is arranged at a nearer location to the support than the receptor layer.

In the image-receiving sheet for use in the present invention, the heat insulation layer contains hollow polymer particles.

The hollow polymer particles in the present invention are polymer particles having independent pores inside of the particles. Examples of the hollow polymer particles include (1) non-foaming type hollow particles obtained in the following manner: water is contained inside of a capsule wall formed of a polystyrene, acryl resin, or styrene/acryl resin and, after a coating solution is applied and dried, the water in the particles is vaporized out of the particles, with the result that the inside of each particle forms a hollow; (2) foaming type microballoons obtained in the following manner: a low-boiling point liquid such as butane and pentane is encapsulated in a resin constituted of any one of polyvinylidene chloride, polyacrylonitrile, polyacrylic acid and polyacrylate, and their mixture or polymer, and after the resin coating material is applied, it is heated to expand the low-boiling point liquid inside of the particles whereby the inside of each particle is made to be hollow; and (3) microballoons obtained by foaming the above (2) under heating in advance, to make hollow polymer particles.

These hollow polymer particles preferably have a hollow ratio of about 20 to 70%, and may be used in combinations of two or more. Specific examples of the above (1) include Rohpake 1055 manufactured by Rohm and Haas Co.; Boncoat PP-1000 manufactured by Dainippon Ink and Chemicals, Incorporated; SX866(B) manufactured by JSR Corporation; and Nippol MH5055 manufactured by Nippon Zeon (all of these product names are trade names). Specific examples of the above (2) include F-30 and F-50 manufactured by Matsumoto Yushi-Seiyaku Co., Ltd. (all of these product names are trade names). Specific examples of the above (3) include F-30E manufactured by Matsumoto Yushi-Seiyaku Co., Ltd, and Expancel 461DE, 551DE and 551DE20 manufactured by Nippon Ferrite (all of these product names are trade names). The hollow polymer particles for use in the heat insulation layer may be a latex thereof.

A water-dispersible resin or water-soluble type resin is preferably contained, as a binder, in the heat insulation layer containing the hollow polymer particles. As the binder resin that can be used in the present invention, known resins such as an acryl resin, styrene/acryl copolymer, polystyrene resin, polyvinyl alcohol resin, vinyl acetate resin, ethylene/vinyl acetate copolymer, vinyl chloride/vinyl acetate copolymer, styrene/butadiene copolymer, polyvinylidene chloride resin, cellulose derivative, casein, starch, and gelatin may be used. Also, these resins may be used either singly or as mixtures.

The solid content of the hollow polymer particles in the heat insulation layer preferably falls in a range from 5 to 2,000 parts by mass when the solid content of the binder resin is 100 parts by mass. Also, the ratio by mass of the solid content of the hollow polymer particles in the coating solution is preferably 1 to 70% by mass and more preferably 10 to 40% by mass. If the ratio of the hollow polymer particles is excessively low, sufficient heat insulation cannot be obtained, whereas if the ratio of the hollow polymer particles is excessively large, the adhesion between the hollow polymer particles is reduced, posing problems, for example, powder fall or film separation upon processing.

The particle size of the hollow polymer particles is preferably 0.1 to 20 μm, more preferably 0.1 to 2 μm and particularly preferably 0.1 to 1 μm. Also, the glass transition temperature (Tg) of the hollow polymer particles is preferably 70° C. or more and more preferably 100° C. or more.

The heat insulation layer of the heat-sensitive transfer image-receiving sheet that is used in the present invention is free of any resins having poor resistance to an organic solvent, except for the hollow polymer particles, or it is free of any aqueous dispersion of the resin having poor resistance to an organic solvent. Incorporation of the resin having poor resistance to an organic solvent (resin having a dye-dyeing affinity) in the heat insulation layer is not preferable in view of increase in loss of image definition after image transfer. It is assumed that the color-edge definition loss increases by the reason that owing to the presence of both the resin having a dye-dyeing affinity and the hollow polymer particles in the heat insulation layer, a transferred dye that has dyed the receptor layer migrates through the heat insulation layer adjacent thereto at the lapse of time.

Herein, the term "poor resistance to an organic solvent" means that a solubility in an organic solvent (e.g., methyl ethyl ketone, ethyl acetate, benzene, toluene, xylene) is 1 mass % or more, preferably 0.5 mass % or more. For example, the above-mentioned polymer latex is included in the category of the resin having "poor resistance to an organic solvent".

The heat insulation layer preferably contains the above-mentioned water-soluble polymer. Preferable compounds of the water-soluble polymer are the same as mentioned above.

An amount of the water-soluble polymer to be added in the heat insulation layer is preferably from 1 to 75 mass %, more preferably from 1 to 50 mass % to the entire heat insulation layer.

The heat insulation layer preferably contains a gelatin. The amount of the gelatin in the coating solution for the heat insulation layer is preferably 0.5 to 14% by mass, and particularly preferably 1 to 6% by mass. Also, the coating amount of the above hollow polymer in the heat insulation layer is preferably 1 to 100 g/m$^2$, and more preferably 5 to 20 g/m$^2$.

The water-soluble polymer that is contained in the heat insulation layer is preferably cross-linked with the crosslinking agent. Preferable compounds as well as a preferable amount of the crosslinking agent to be used are the same as mentioned above.

A preferred ratio of a cross-linked water-soluble polymer in the heat insulation layer varies depending on the kind of the crosslinking agent, but the water-soluble polymer in the heat insulation layer is crosslinked by preferably 0.1 to 20 mass %, more preferably 1 to 10 mass %, based on the entire water-soluble polymer.

A thickness of the heat insulation layer containing the hollow polymer particles is preferably from 5 to 50 μm, more preferably from 5 to 40 μm.

(Undercoat Layer)

An undercoat layer is preferably formed between the receptor layer and the support. As the undercoat layer, for example, a white background regulation layer, a charge regulation layer, an adhesive layer or a primer layer is formed. These layers may be formed in the same manner as those described in, for example, each specification of Japanese Patent Nos. 3,585,599 and 2,925,244.

(Support)

In the present invention, a waterproof support is preferably used as the support. The use of the waterproof support makes it possible to prevent the support from absorbing moisture, whereby a fluctuation in the performance of the receptor layer with time can be prevented. As the waterproof support, for example, coated paper or laminate paper may be used.

-Coated Paper-

The coated paper is paper obtained by coating a sheet such as base paper with various resins, rubber latexes, or high-molecular materials, on one side or both sides of the sheet, wherein the coating amount differs depending on its use. Examples of such coated paper include art paper, cast coated paper, and Yankee paper.

It is proper to use a thermoplastic resin as the resin to be applied to the surface(s) of the base paper. As such a thermoplastic resin, the following thermoplastic resins (A) to (H) may be exemplified.

(A) Polyolefin resins such as polyethylene resin and polypropylene resin; copolymer resins composed of an olefin such as ethylene or propylene and another vinyl monomer; acrylic resin, etc.

(B) Thermoplastic resins having an ester linkage: for example, polyester resins obtained by condensation of a dicarboxylic acid component (such a dicarboxylic acid component may be substituted with a sulfonic acid group, a carboxyl group, or the like) and an alcohol component (such an alcohol component may be substituted with a hydroxyl group, or the like); polyacrylate resins or polymethacrylate resins such as polymethyl methacrylate, polybutyl methacrylate, polymethyl acrylate, polybutyl acrylate, or the like; polycarbonate resins, polyvinyl acetate resins, styrene acrylate resins, styrene-methacrylate copolymer resins, vinyltoluene acrylate resins, or the like.

Concrete examples of them include those described in JP-A-59-101395, JP-A-63-7971, JP-A-63-7972, JP-A-63-7973, and JP-A-60-294862.

Commercially available thermoplastic resins usable include, for example, Vylon 290, Vylon 200, Vylon 280, Vylon 300, Vylon 103, Vylon GK-140, and Vylon GK-130 (products of Toyobo Co., Ltd.); Tafton NE-382, Tafton U-5, ATR-2009, and ATR-2010 (products of Kao Corporation); Elitel UE 3500, UE 3210, XA-8153, KZA-7049, and KZA-1449 (products of Unitika Ltd.); and Polyester TP-220 and R-188 (products of The Nippon Synthetic Chemical Industry Co., Ltd.); and thermoplastic resins in the Hyros series from Seiko Chemical Industries Co., Ltd., and the like (all of these names are trade names).

(C) Polyurethane resins, etc.

(D) Polyamide resins, urea resins, etc.

(E) Polysulfone resins, etc.

(F) Polyvinyl chloride resins, polyvinylidene chloride resins, vinyl chloride/vinyl acetate copolymer resins, vinyl chloride/vinyl propionate copolymer resins, etc.

(G) Polyol resins such as polyvinyl butyral; and cellulose resins such as ethyl cellulose resin and cellulose acetate resin, etc., and (H) Polycaprolactone resins, styrene/maleic anhydride resins, polyacrylonitrile resins, polyether resins, epoxy resins, and phenolic resins, etc.

The thermoplastic resins may be used either alone or in combination of two or more.

The thermoplastic resin may contain a whitener, a conductive agent, a filler, a pigment or dye including, for example, titanium oxide, ultramarine blue, and carbon black; or the like, if necessary.

-Laminated Paper-

The laminated paper is a paper which is formed by laminating various kinds of resin, rubber, polymer sheets or films on a sheet such as a base paper or the like. Specific examples of the materials useable for the lamination include polyolefins, polyvinyl chlorides, polyethylene terephthalates, polystyrenes, polymethacrylates, polycarbonates, polyimides, and triacetylcelluloses. These resins may be used alone, or in combination of two or more.

Generally, the polyolefins are prepared by using a low-density polyethylene. However, for improving the thermal resistance of the support, it is preferred to use a polypropylene, a blend of a polypropylene and a polyethylene, a high-density polyethylene, or a blend of a high-density polyethylene and a low-density polyethylene. From the viewpoint of cost and its suitableness for the laminate, it is particularly preferred to use the blend of a high-density polyethylene and a low-density polyethylene.

The blend of a high-density polyethylene and a low-density polyethylene is, for example, used in a blend ratio (a mass ratio) of 1/9 to 9/1, preferably 2/8 to 8/2, and further preferably 3/7 to 7/3. When the thermoplastic resin layer is formed on the both surfaces of the support, the back side of the support is preferably formed using, for example, the high-density polyethylene or the blend of a high-density polyethylene and a low-density polyethylene. The molecular weight of the polyethylenes is not particularly limited. Preferably, both of the high-density polyethylene and the low-density polyethylene have a melt index of from 1.0 to 40 g/10-minute and an extrudability.

The sheet or film may be subjected to a treatment to impart white reflection thereto. As a method of such a treatment, for example, a method of incorporating a pigment such as titanium oxide into the sheet or film can be mentioned.

The thickness of the support is preferably from 25 μm to 300 μm, more preferably from 50 μm to 260 μm, and further preferably from 75 μm to 220 μm. The support can have any rigidity according to the purpose. When it is used as a support for electrophotographic image-receiving sheet of photographic image quality, the rigidity thereof is preferably near to that in a support for use in color silver halide photography.

(Curling Control Layer)

When the support is exposed as it is, there may be the case where the heat-sensitive transfer image-receiving sheet is made to curl by moisture and/or temperature in the environment. It is therefore preferable to form a curling control layer on the backside of the support. The curling control layer not only prevents the image-receiving sheet from curling but also has a water-proof function. For the curling control layer, a polyethylene laminate, a polypropylene laminate or the like is used. Specifically, the curling control layer may be formed in a manner similar to those described in, for example, JP-A-61-110135 and JP-A-6-202295.

(Writing Layer and Charge Controlling Layer)

For the writing layer and the charge control layer, an inorganic oxide colloid, an ionic polymer, or the like may be used. As the antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge control layer may be formed in a manner similar to those described in the specification of Japanese Patent No. 3585585.

Next, the heat-sensitive (thermal) transfer sheet (ink sheet) for use in the present invention is explained below.

The ink sheet that is used in combination with the above-mentioned heat-sensitive transfer image-receiving sheet at the time when a thermal transfer image is formed, is provided with, on a support, a thermal transfer layer containing a diffusion transfer dye (hereinafter, also referred to as "dye layer"). The dye layer is applied using a usual method such as a roll coating, a bar coating, a gravure coating, and a gravure reverse coating.

As a substrate material of the ink sheet, a plastic film is suitable such as a polyester film, a polystylene film, a polysulfone film, polyimide film, polyvinyl alcohol film, and cellophane. In a preferable embodiment of the present invention, a thermal transfer dye-providing material is composed of a cyan dye, a magenta dye, and a yellow dye, each of which is successively coated in a region on a polyethylene terephthalate support. The above-described thermal transfer step is performed for each dye in success to form three color transfer image. As a matter of course, when the thermal transfer step is performed by monochrome, a monochromatic transfer image is obtained.

(Heat-sensitive (Thermal) Transferring Layer)

The thermal transfer layer (dye layer) of the ink sheet for use in the present invention preferably contains at least one dye represented by formula (7) or (8), as a yellow dye. Further, the dye layer preferably contains at least one dye represented by formula (9), (10) or (11), as a magenta dye. Further, the dye layer preferably contains at least one dye represented by formula (12) or (13), as a cyan dye. Furthermore, the dye layer more preferably contains at least one dye represented by formula (7) or (8) as a yellow dye, at least one dye represented by formula (9), (10) or (11) as a magenta dye, and at least one dye represented by formula (12) or (13) as a cyan dye.

The preferable dyes are explained below.

First, the dye represented by formula (7) is explained in detail.

Formula (7)

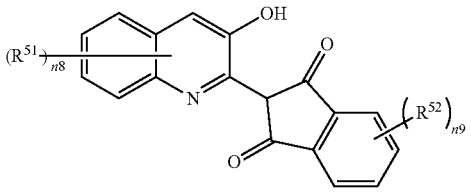

In formula (7), $R^{51}$ and $R^{52}$ each independently represent a substituent; n8 represents an integer of 0 to 5; and n9 represents an integer of 0 to 4.

In formula (7), $R^{51}$ and $R^{52}$ each independently represent a substituent.

Herein, the substituent is explained in detail. Examples of the substituent include a halogen atom, an alkyl group including a cycloalkyl group irrespective of the number of rings, an alkenyl group including a cycloalkenyl group irrespective of the number of rings, an alkynyl group, an aryl group, a heterocyclic group, a cyano group, an alkoxy group, an aryloxy group, an acyloxy group, a carbamoyloxy group, an alkoxycarbonyloxy group, an aryloxycarbonyloxy group, an amino group including an alkylamino group and an anilino group, an acylamino group, an aminocarbonylamino group, an alkoxycarbonylamino group, an aryloxycarbonylamino group, a sulfamoylamino group, an alkyl- or aryl-sulfonylamino group, an alkylthio group, a sulfamoyl group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, and an imido group. Each group may be further substituted.

Herein, $R^{51}$ and $R^{52}$ are described in more detail.

Examples of the halogen atom represented by $R^{51}$ and $R^{52}$ include a fluorine atom, a chlorine atom, a bromine atom, and an iodine atom. Among these, a chlorine atom and a bromine atom are preferably, and a chlorine atom is particularly preferable.

The alkyl group represented by $R^{51}$ and $R^{52}$ includes a cycloalkyl group and a bicycloalkyl group. The alkyl group also includes straight or branched chain and substituted or unsubstituted alkyl groups. The straight or branched chain and substituted or unsubstituted alkyl groups are preferably ones having 1 to 30 carbon atoms. Examples thereof include methyl, ethyl, n-propyl, isopropyl, t-butyl, n-octyl, eicosyl, 2-chloroethyl, 2-cyanoethyl and 2-ethylhexyl. The cycloalkyl group includes substituted or unsubstituted cycloalkyl groups. The substituted or unsubstituted cycloalkyl groups are preferably ones having 3 to 30 carbon atoms. Examples thereof include cyclohexyl, cyclopentyl, and 4-n-dodecylcyclohexyl. The bicycloalkyl group is preferably a substituted or unsubstituted bicycloalkyl group having from 5 to 30 carbon atoms, namely, a monovalent group resultant from removing one hydrogen atom of a bicycloalkane having from 5 to 30 carbon atoms. Examples thereof include bicyclo[1,2,2]heptane-2-yl and bicyclo[2,2,2]octane-3-yl. The alkyl group also includes alkyl groups having a multi-ring structure such as a tricyclo structure. The above-mentioned concept of the alkyl group is also applied to an alkyl moiety of the substituents (e.g., an alkyl moiety of the alkylthio group) that are explained below.

The alkenyl group represented by $R^{51}$ and $R^{52}$ includes a cycloalkenyl group and a bicycloalkenyl group. The alkenyl group also includes straight or branched chain or cyclic, and substituted or unsubstituted alkenyl groups. The alkenyl group is preferably a substituted or unsubstituted alkenyl group having 2 to 30 carbon atoms. Examples thereof include vinyl, allyl, prenyl, geranyl and oleyl. The cycloalkenyl group is preferably a substituted or unsubstituted cycloalkenyl group having 3 to 30 carbon atoms, namely a monovalent group resultant from removing one hydrogen atom of a cycloalkene having 3 to 30 carbon atoms. Examples thereof include 2-cyclopentene-1-yl and 2-cyclohexene-1-yl. The bicycloalkenyl group includes a substituted or unsubstituted bicycloalkenyl group. The bicycloalkenyl group is preferably a substituted or unsubstituted bicycloalkenyl group having 5 to 30 carbon atoms, namely a monovalent group resultant from removing one hydrogen atom from a bicycloalkene having one double bond. Examples thereof include bicyclo[2,2,1]hept-2-ene-1-yl and bicyclo[2,2,2]oct-2-ene-4-yl.

The alkynyl group represented by $R^{51}$ and $R^{52}$ is preferably a substituted or unsubstituted alkynyl group having 2 to 30 carbon atoms. Examples thereof include ethynyl and propargyl.

The aryl group represented by $R^{51}$ and $R^{52}$ is preferably a substituted or unsubstituted aryl group having 6 to 30 carbon atoms. Examples thereof include phenyl, p-tolyl, naphthyl, m-chlorophenyl and o-hexadecanoylaminophenyl.

The heterocyclic group represented by $R^{51}$ and $R^{52}$ is preferably a monovalent group resultant from removing one hydrogen atom from a substituted or unsubstituted and aromatic or non-aromatic 5- or 6-membered heterocyclic compound. The hetero ring in the heterocyclic group may be a condensed ring. The heterocyclic group is more preferably a 5- or 6-membered aromatic heterocyclic group having 3 to 30 carbon atoms. In place of the heterocyclic group, hetero rings are exemplified below without denotation of their substitution sites: pyridine, pyrazine, pyridazine, pyrimidine, triazine, quinoline, isoquinoline, quinazoline, cinnoline, phthalazine, quinoxaline, pyrrol, indole, furan, benzofuran, thiophene, benzothiophene, pyrrazole, imidazole, benzimidazole, triazole, oxazole, benzoxazole, thiazole, benzothiazole, isothiazole, benzisothiazole, thiadiazole, isoxazole, benzoisoxazole, pyrrolidine, piperidine, piperazine, imidazolidine and thiazoline.

The alkoxy group represented by $R^{51}$ and $R^{52}$ includes a substituted or unsubstituted alkoxy group. The substituted or unsubstituted alkoxy group is preferably an alkoxy group having 1 to 30 carbon atoms. Examples of the alkoxy group include methoxy, ethoxy, isopropoxy, n-octyloxy, methoxyethoxy, hydroxyethoxy and 3-carboxypropoxy.

The aryloxy group represented by $R^{51}$ and $R^{52}$ is preferably a substituted or unsubstituted aryloxy group having 6 to 30 carbon atoms. Examples of the aryloxy group include phenoxy, 2-methylphenoxy, 4-t-butylphenoxy, 3-nitrophenoxy and 2-tetradecanoylaminophenoxy.

The acyloxy group represented by $R^{51}$ and $R^{52}$ is preferably a formyloxy group, a substituted or unsubstituted alkylcarbonyloxy group having 2 to 30 carbon atoms, and a substituted or unsubstituted arylcarbonyloxy group having 6 to 30 carbon atoms. Examples of the acyloxy group include formyloxy, acetyloxy, pivaloyloxy, stearoyloxy, benzoyloxy and p-methoxyphenyl carbonyloxy.

The carbamoyloxy group represented by $R^{51}$ and $R^{52}$ is preferably a substituted or unsubstituted carbamoyloxy group having 1 to 30 carbon atoms. Examples of the carbamoyloxy group include N,N-dimethylcarbamoyloxy, N,N-diethylcarbamoyloxy, morpholino carbonyloxy, N,N-di-n-octylaminocarbonyloxy and N-n-octylcarbamoyloxy.

The alkoxycarbonyloxy group represented by $R^{51}$ and $R^{52}$ is preferably a substituted or unsubstituted alkoxycarbonyloxy group having 2 to 30 carbon atoms. Examples of the alkoxycarbonyloxy group include methoxycarbonyloxy, ethoxycarbonyloxy, t-butoxycarbonyloxy and n-octylcarbonyloxy.

The aryloxycarbonyloxy group represented by $R^{51}$ and $R^{52}$ is preferably a substituted or unsubstituted aryloxycarbonyloxy group having 7 to 30 carbon atoms. Examples of the aryloxycarbonyloxy group include phenoxycarbonyloxy, p-methoxyphenoxycarbonyloxy and p-n-hexadecyloxyphenoxycarbonyloxy.

The amino group represented by $R^{51}$ and $R^{52}$ includes an alkylamino group and an arylamino group. The amino group is preferably a substituted or unsubstituted alkylamino group having 1 to 30 carbon atoms or a substituted or unsubstituted arylamino group having 6 to 30 carbon atoms. Examples of the amino group include amino, methylamino, dimethylamino, anilino, N-methyl-anilino, diphenylamino, hydroxyethylamino, carboxyethylamino, sulfoethylamino and 3,5-dicarboxyanilino.

The acylamino group represented by $R^{51}$ and $R^{52}$ is preferably a formylamino group, a substituted or unsubstituted alkylcarbonylamino group having 1 to 30 carbon atoms or a substituted or unsubstituted arylcarbonylamino group having 6 to 30 carbon atoms. Examples of the acylamino group include formylamino, acetylamino, pivaloylamino, lauroylamino, benzoylamino and 3,4,5-tri-n-octyloxyphenylcarbonylamino.

The aminocarbonylamino group represented by $R^{51}$ and $R^{52}$ is preferably a substituted or unsubstituted aminocarbonylamino group having 1 to 30 carbon atoms. Examples of the aminocarbonylamino group include carbamoylamino, N,N-dimethylaminocarbonylamino, N,N-diethylaminocarbonylamino and morpholinocarbonylamino.

The alkoxycarbonylamino group represented by $R^{51}$ and $R^{52}$ is preferably a substituted or unsubstituted alkoxycarbonylamino group having 2 to 30 carbon atoms. Examples of the alkoxycarbonylamino group include methoxycarbonylamino, ethoxycarbonylamino, t-butoxycarbonylamino, n-octadecyloxycarbonylamino and N-methyl-methoxycarbonylamino.

The aryloxycarbonylamino group represented by $R^{51}$ and $R^{52}$ is preferably a substituted or unsubstituted aryloxycarbonylamino group having 7 to 30 carbon atoms. Examples of the aryloxycarbonylamino group include phenoxycarbonylamino, p-chlorophenoxycarbonylamino and m-n-octyloxyphenoxycarbonylamino.

The sulfamoylamino group represented by $R^{51}$ and $R^{52}$ is preferably a substituted or unsubstituted sulfamoylamino group having 0 to 30 carbon atoms. Examples of the sulfamoylamino group include sulfamoylamino, N,N-dimethylaminosulfonylamino and N-n-octylaminosulfonylamino.

The alkyl- or aryl-sulfonylamino group represented by $R^{51}$ and $R^{52}$ is preferably a substituted or unsubstituted alkylsulfonylamino group having 1 to 30 carbon atoms or a substituted or unsubstituted arylsulfonylamino group having 6 to 30 carbon atoms. Examples of the alkylsulfonylamino group and the arylsulfonylamino group include methylsulfonylamino, butylsulfonylamino, phenylsulfonylamino, 2,3,5-trichlorophenylsulfonylamino and p-methylphenylsulfonylamino.

The alkylthio group represented by $R^{51}$ and $R^{52}$ is preferably a substituted or unsubstituted alkylthio group having 1 to 30 carbon atoms. Examples of the alkylthio group include methylthio, ethylthio and n-hexadecylthio.

The sulfamoyl group represented by $R^{51}$ and $R^{52}$ is preferably a substituted or unsubstituted sulfamoyl group having 0 to 30 carbon atoms. Examples of the sulfamoyl group include N-ethylsulfamoyl, N-(3-dodecyloxypropyl)sulfamoyl, N,N-dimethylsulfamoyl, N-acetylsulfamoyl, N-benzoylsulfamoyl and N—(N'-phenylcarbamoyl)sulfamoyl.

The alkyl- or aryl-sulfinyl group represented by $R^{51}$ and $R^{52}$ is preferably a substituted or unsubstituted alkylsulfinyl group having 1 to 30 carbon atoms or a substituted or unsubstituted arylsulfinyl group having 6 to 30 carbon atoms. Examples of the alkylsulfinyl group and the arylsulfinyl group include methylsulfinyl, ethylsulfinyl, phenylsulfinyl and p-methylphenylsulfinyl.

The alkyl- or aryl-sulfonyl group represented by $R^{51}$ and $R^{52}$ is preferably a substituted or unsubstituted alkylsulfonyl group having 1 to 30 carbon atoms or a substituted or unsubstituted arylsulfonyl group having 6 to 30 carbon atoms. Examples of the alkylsulfonyl group and the arylsulfonyl group include methylsulfonyl, ethylsulfonyl, phenylsulfonyl and p-toluenesulfonyl.

The acyl group represented by $R^{51}$ and $R^{52}$ is preferably a formyl group, a substituted or unsubstituted alkylcarbonyl group having 2 to 30 carbon atoms, a substituted or unsubstituted arylcarbonyl group having 7 to 30 carbon atoms, or a substituted or unsubstituted heterocyclic carbonyl group having 4 to 30 carbon atoms in which one of the carbon atoms in the hetero ring bonds to the carbonyl moiety. Examples of the acyl group include acetyl, pivaloyl, 2-chloroacetyl, stearoyl, benzoyl, p-n-octyloxyphenylcarbonyl, 2-pyridylcarbonyl and 2-furylcarbonyl.

The aryloxycarbonyl group represented by $R^{51}$ and $R^{52}$ is preferably a substituted or unsubstituted aryloxycarbonyl group having 7 to 30 carbon atoms. Examples of the aryloxycarbonyl group include phenoxycarbonyl, o-chlorophenoxycarbonyl, m-nitrophenoxycarbonyl and p-t-butylphenoxycarbonyl.

The alkoxycarbonyl group represented by $R^{51}$ and $R^{52}$ is preferably a substituted or unsubstituted alkoxycarbonyl group having 2 to 30 carbon atoms. Examples of the alkoxycarbonyl group include methoxycarbonyl, ethoxycarbonyl, t-butoxycarbonyl and n-octadecyloxycarbonyl.

The carbamoyl group represented by $R^{51}$ and $R^{52}$ is preferably a substituted or unsubstituted carbamoyl group having 1 to 30 carbon atoms. Examples of the carbamoyl group include carbamoyl, N-methylcarbamoyl, N,N-dimethylcarbamoyl, N,N-di-n-octylcarbamoyl and N-(methylsulfonyl) carbamoyl.

Examples of the aryl- or heterocyclic-azo group represented by $R^{51}$ and $R^{52}$ include phenylazo, 4-methoxyphenylazo, 4-pivaloylaminophenylazo and 2-hydroxy-4-propanoylphenylazo.

Examples of the imido group represented by $R^{51}$ and $R^{52}$ include N-succinimido and N-phthalimido.

$R^{51}$ and $R^{52}$ each independently preferably represent a substituted or unsubstituted alkyl group, a substituted or unsubstituted alkenyl group, a substituted or unsubstituted aryl group, or a substituted or unsubstituted heterocyclic group; more preferably a substituted or unsubstituted alkyl group.

$R^{51}$ preferably represents a substituted or unsubstituted alkyl group, a substituted or unsubstituted alkenyl group, a substituted or unsubstituted aryl group or a substituted or unsubstituted heterocyclic group; more preferably a substituted or unsubstituted alkyl group; and further preferably a substituted or unsubstituted alkyl group having 1 to 6 carbon atoms.

$R^{52}$ preferably represents a substituted or unsubstituted alkyl group, a substituted or unsubstituted alkenyl group, a substituted or unsubstituted aryl group or a substituted or unsubstituted heterocyclic group; more preferably a substituted or unsubstituted alkyl group; further preferably an aryloxycarbonyl group having 6 to 10 carbon atoms, an alkoxycarbonyl group having 1 to 6 carbon atoms or a substituted or unsubstituted carbamoyl group; and most preferably a substituted carbamoyl group.

n8 is preferably an integer of 0 to 3; more preferably an integer of 0 to 2; and further preferably an integer of 0 or 1.

n9 is preferably an integer of 0 to 3; and more preferably an integer of 0 to 2.

The following is an explanation about a preferable combination of various substituents (groups or atoms) that a dye represented by formula (7) may have: A preferred dye is a dye in which at least one of the substituents is the above-described preferable substituent. A more preferred dye is a dye in which many various substituents are the above-described preferable substituents. The most preferred dye is a dye in which all substituents are the above-described preferable substituents.

The dye represented by formula (8) is explained in detail.

Formula (8)

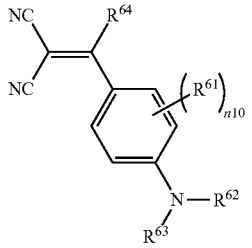

In formula (8), $R^{61}$ represents a substituent, and $R^{62}$, $R^{63}$ and $R^{64}$ each independently represent a hydrogen atom or a substituent. Examples of the substituents each represented by $R^{61}$ to $R^{64}$ include those given as examples of the substituents of the above-described $R^{51}$ and $R^{52}$. n10 represents an integer of 0 to 4.

$R^{61}$ preferably represents a substituted or unsubstituted alkyl group, a substituted or unsubstituted alkenyl group, a substituted or unsubstituted aryl group or a substituted or unsubstituted heterocyclic group; more preferably a substituted or unsubstituted alkyl group; and further preferably a substituted or unsubstituted alkyl group having 1 to 6 carbon atoms.

$R^{62}$ and $R^{63}$ each independently preferably represent a hydrogen atom, a substituted or unsubstituted alkyl group, a substituted or unsubstituted alkenyl group, a substituted or unsubstituted aryl group, or a substituted or unsubstituted heterocyclic group; more preferably a hydrogen atom or a substituted or unsubstituted alkyl group; and further preferably a hydrogen atom or a substituted or unsubstituted alkyl group having 1 to 6 carbon atoms.

$R^{64}$ preferably represents a hydrogen atom, a substituted or unsubstituted alkyl group, a substituted or unsubstituted alkenyl group, a substituted or unsubstituted aryl group or a substituted or unsubstituted heterocyclic group; more preferably a hydrogen atom or a substituted or unsubstituted alkyl group; further preferably a hydrogen atom or a substituted or unsubstituted alkyl group having 1 to 6 carbon atoms; and most preferably a hydrogen atom.

n10 is preferably an integer of 0 or 1.

The following is an explanation about a preferable combination of various substituents (atoms) that a dye represented by formula (8) may have: A preferred compound is a compound in which at least one of the substituents is the above-described preferable substituent. A more preferred compound is a compound in which many various substituents are the above-described preferable substituents. The most preferred compound is a compound in which all substituents are the above-described preferable substituents.

Next, the dyes represented by formula (9) or (10) are explained in detail.

Formula (9)

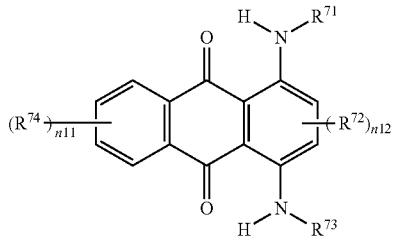

In formula (9), $R^{71}$ and $R^{73}$ each independently represents a hydrogen atom or a substituent, $R^{72}$ and $R^{74}$ each independently represents a substituent, n11 represents an integer of 0 to 4, and n12 represents an integer of 0 to 2. When n11 represents an integer of 2 to 4, $R^{74}$s may be the same or different from each other. When n12 represents 2, $R^{72}$s may be the same or different from each other. Examples of the substituents each represented by $R^{71}$ to $R^{74}$ include those given as examples of the substituent each represented by $R^{51}$ and $R^{52}$ set forth above.

Examples of the substituent represented by $R^{71}$ and $R^{73}$ include those given as examples of the substituents as described about $R^{51}$ in formula (7), and preferable examples thereof are also same. $R^{71}$ and $R^{73}$ each are more preferably a hydrogen atom or a substituted or unsubstituted alkyl group having 1 to 6 carbon atoms, and further preferably a hydrogen atom.

Examples of the substituent represented by $R^{72}$ and $R^{74}$ include those given as examples of the substituent as described about $R^{51}$ in formula (7). $R^{72}$ and $R^{74}$ each independently are more preferably an alkoxy group, an aryloxy group, an acyloxy group, a carbamoyloxy group, an alkoxycarbonyloxy group or an aryloxycarbonyloxy group; and further preferably an alkoxy group and an aryloxy group. Each of these groups may be further substituted.

n11 is preferably an integer of 0.

n12 is preferably an integer of 2.

Formula (10)

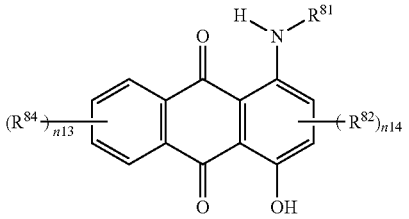

In formula (10), $R^{81}$ represents a hydrogen atom or a substituent, $R^{82}$ and $R^{84}$ each independently represents a substituent, n13 represents an integer of 0 to 4, and n14 represents an integer of 0 to 2. When n13 represents an integer of 2 to 4, $R^{84}$s may be the same or different from each other. When n14 represents 2, $R^{82}$s may be the same or different from each other. Examples of the substituents each represented by $R^{81}$, $R^{82}$ and $R^{84}$ include those given as examples of the substituent each represented by $R^5$ and $R^{52}$ set forth above.

Examples of the substituent represented by $R^{81}$ include those given as examples of the substituents as described about $R^{51}$ and $R^{52}$, and preferable examples thereof are also same. $R^{81}$ is more preferably a hydrogen atom or a substituted or unsubstituted alkyl group having 1 to 6 carbon atoms, and further preferably a hydrogen atom.

Examples of the substituent represented by $R^{82}$ and $R^{84}$ include those given as examples of the substituent as described about $R^{51}$ in formula (7). $R^{82}$ and $R^{84}$ each independently are more preferably an alkoxy group, an aryloxy group, an acyloxy group, a carbamoyloxy group, an alkoxycarbonyloxy group and an aryloxycarbonyloxy group; and further preferably an alkoxy group and an aryloxy group. Each of these groups may be further substituted.

n13 is preferably an integer of an integer of 0 or 1, and more preferably 0.

n14 is preferably an integer an integer of 0 or 1, and more preferably an integer of 1.

The following is an explanation about a preferable combination of various substituents (atoms) that a dye represented by formula (9) or (10) may have: A preferred compound is a compound in which at least one of the substituents is the above-described preferable substituent. A more preferred compound is a compound in which many various substituents are the above-described preferable substituents. The most preferred compound is a compound in which all substituents are the above-described preferable substituents.

Next, the dye represented by formula (11) is explained in detail.

Formula (11)

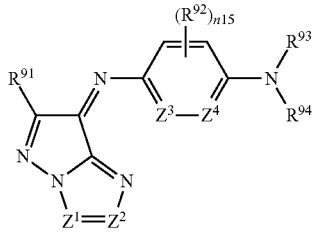

In formula (11), $R^{91}$ represents a hydrogen atom or a substituent, $R^{92}$ represents a substituent, $R^{93}$ and $R^{94}$ each independently represents a hydrogen atom or a substituent, and n15 represents an integer of 0 to 2. When n15 represents 2, $R^{92}$s may be the same or different from each other. One of $Z^1$ and $Z^2$ represents =N— and the other represents =C($R^{95}$)—. $Z^3$ and $Z^4$ each independently represents =N— or =C($R^{95}$)—. $R^{95}$ represents a hydrogen atom or a substituent. Examples of the substituents each represented by $R^{91}$ to $R^{95}$ include those given as examples of the substituent each represented by $R^{51}$ and $R^{52}$ set forth above.

$R^{91}$ is preferably a hydrogen atom, a substituted or unsubstituted alkyl group, a substituted or unsubstituted alkenyl group, a substituted or unsubstituted aryl group, a substituted or unsubstituted heterocyclic group or a substituted or unsubstituted amino group; more preferably a substituted or unsubstituted alkyl group or a substituted or unsubstituted aryl group.

Examples of $R^{92}$ include those given as examples of the substituent as described about $R^{51}$ in formula (7), and preferable examples thereof are also the same. $R^{92}$ is more preferably a substituted or unsubstituted alkyl group.

Examples of the substituent represented by $R^{93}$ and $R^{94}$ include those given as examples of the substituents as described about $R^5$ and $R^{52}$, and preferable examples thereof are also same. $R^{93}$ and $R^{94}$ each are preferably a hydrogen atom and a substituted or unsubstituted alkyl group having 1 to 6 carbon atoms, and further preferably a substituted or unsubstituted alkyl group having 1 to 6 carbon atoms.

Examples of the substituent according to $R^{95}$ include those given as examples of the substituent as described about $R^{51}$ in formula (7), and preferable examples thereof are the same. $R^{95}$ is more preferably a hydrogen atom or a substituted or unsubstituted alkyl group.

n15 is preferably an integer of 0.

The following is an explanation about a preferable combination of various substituents (atoms) that a dye represented by formula (11) may have: A preferred compound is a compound in which at least one of the substituents is the above-described preferable substituent. A more preferred compound is a compound in which many various substituents are the above-described preferable substituents. The most preferred compound is a compound in which all substituents are the above-described preferable substituents.

Next, the dyes represented by formula (12) or (13) are explained in detail.

Formula (12)

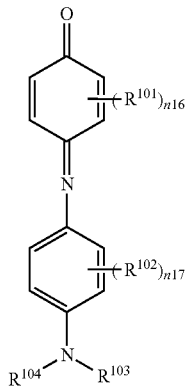

In formula (12), $R^{101}$ and $R^{102}$ each independently represents a substituent, $R^{103}$ and $R^{104}$ each independently represents a hydrogen atom or a substituent. Examples of the substituents each represented by $R^{101}$ to $R^{104}$ include those given as examples of the substituents each represented by $R^{51}$ and $R^{52}$ set forth above. n16 and n17 each independently represents an integer of 0 to 4.

Examples of $R^{101}$ include those given as examples of the substituent as described about $R^{51}$ in formula (7), and preferable examples thereof are also same. $R^{101}$ is more preferably an amino group (including an alkylamino group and an anilino group), an acylamino group, an aminocarbonylamino group, an alkoxycarbonylamino group, an aryloxycarbonylamino group, a sulfamoylamino group, or an alkyl- or arylsulfonylamino group; and further preferably an acylamino group.

Examples of $R^{102}$ include those given as examples of the substituent as described about $R^{51}$ in formula (7) and preferable examples thereof are also same. $R^{102}$ is more preferably a substituted or unsubstituted alkyl group or a substituted or unsubstituted alkoxy group.

Examples of the substituents of $R^{103}$ and $R^{104}$ include those given as examples of the substituents as described about $R^{51}$ and $R^{52}$, and preferable examples thereof are also same. $R^{103}$ and $R^{104}$ each are more preferably a substituted or unsubstituted alkyl group or a substituted or unsubstituted aryl group, and furthermore preferably a substituted or unsubstituted alkyl group.

n16 is preferably an integer of 1 to 3.

n17 is preferably an integer of 0 to 2, and more preferably an integer of 0 or 1.

Formula (13)

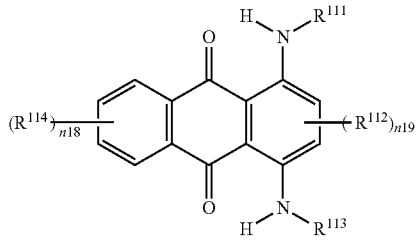

In formula (13), $R^{111}$ and $R^{113}$ each independently represents a hydrogen atom or a substituent, $R^{112}$ and $R^{114}$ each independently represents a substituent, n18 represents an integer of 0 to 4, n19 represents an integer of 0 to 2. When n18 represents an integer of 2 to 4, $R^{114}$s may be the same or different from each other. When n19 represents 2, $R^{112}$s may be the same or different from each other. Examples of the substituents each represented by $R^{111}$ to $R^{114}$ include those given as examples of the substituents each represented by $R^{51}$ and $R^{52}$ set forth above.

Examples of the substituent represented by $R^{111}$ and $R^{113}$ include those given as examples of the substituents as described about $R^{51}$ and $R^{52}$, and preferable examples thereof are also same. $R^{111}$ and $R^{113}$ each are more preferably a hydrogen atom, a substituted or unsubstituted alkyl group having 1 to 6 carbon atoms, or a substituted or unsubstituted aryl group.

Examples of $R^{112}$ and $R^{114}$ include substituents described about $R^{51}$ of formula (7), and a preferable range is also the same as $R^{51}$.

n 18 is preferably an integer of 0.

n 19 is preferably an integer of 0.

The following is an explanation about a preferable combination of various substituents (atoms) that a dye represented by formula (12) or (13) may have: A preferred compound is a compound in which at least one of the substituents is the above-described preferable substituent. A more preferred compound is a compound in which many various substituents are the above-described preferable substituents. The most preferred compound is a compound in which all substituents are the above-described preferable substituents.

Specific examples of the dyes represented by any of formulas (7) to (13) are shown below, but the dyes that can be used in the preset invention should not be construed as being limited to the exemplified compounds set forth below.

(7)-1

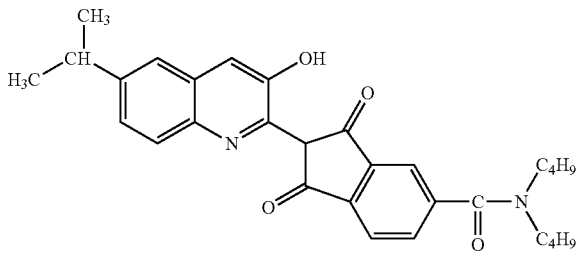

(7)-2

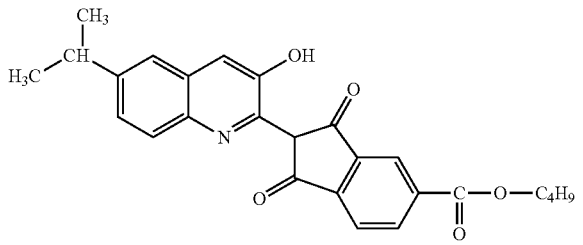

-continued
(7)-3
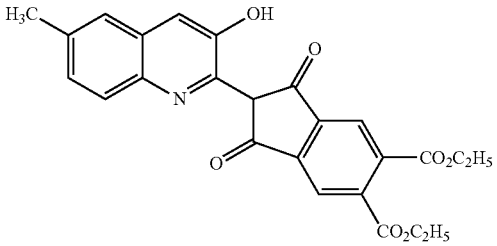
(8)-1
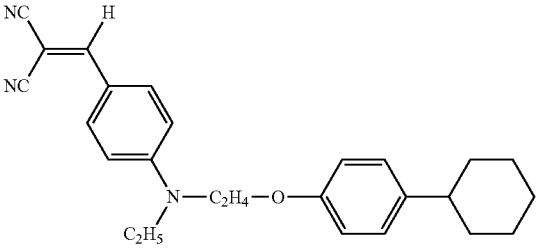
(8)-2
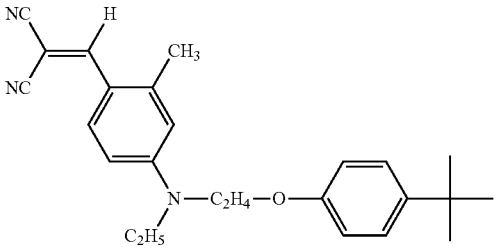
(8)-3
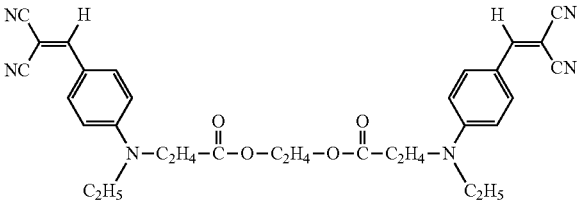
(9)-1
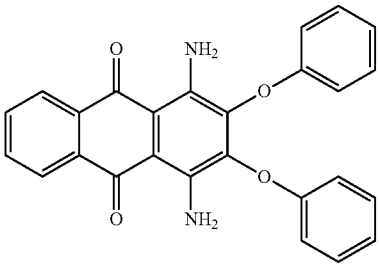
(9)-2
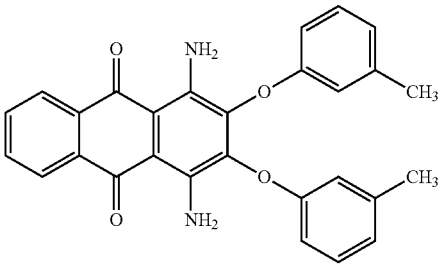
-continued
(10)-1
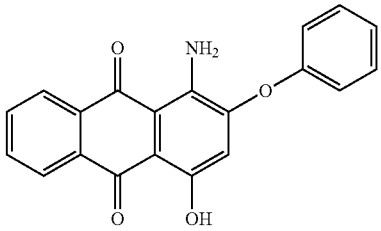
(10)-2
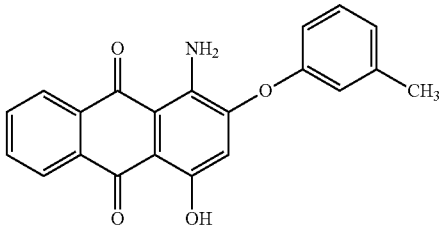
(11)-1
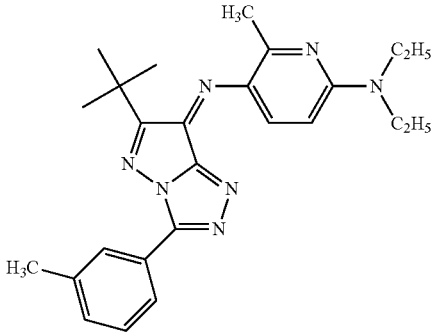
(11)-2
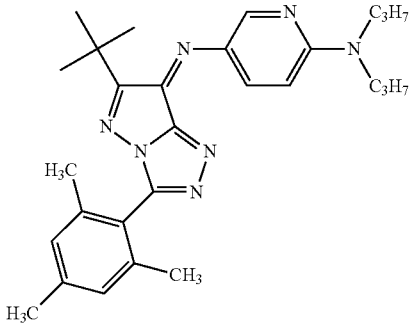
(11)-3
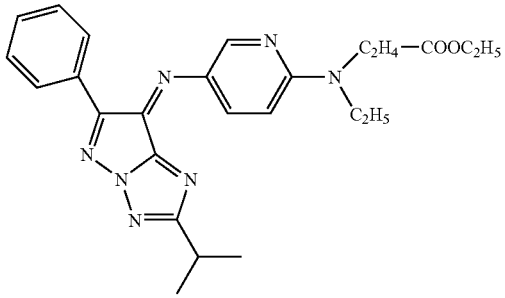

-continued (12)-1

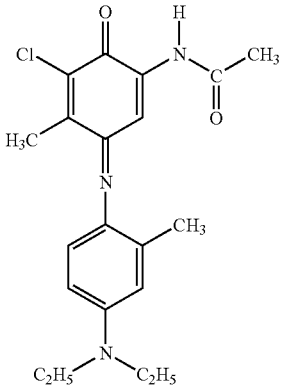

(12)-2

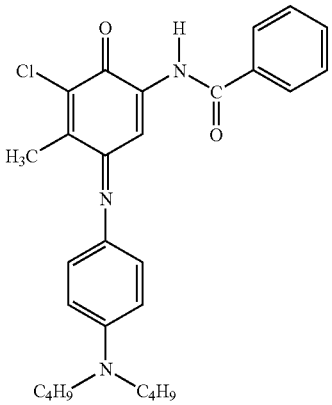

(12)-3

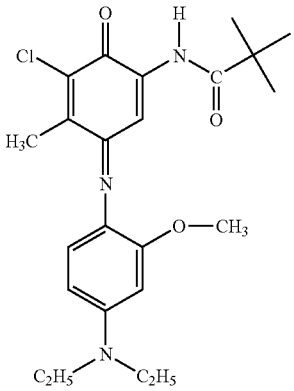

(12)-4

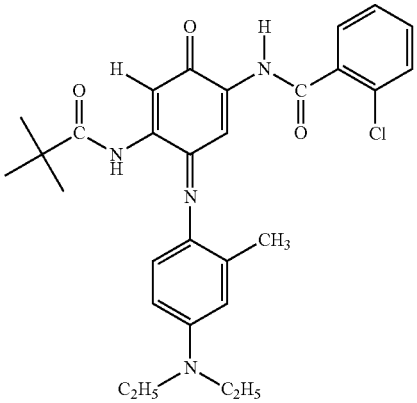

-continued (13)-1

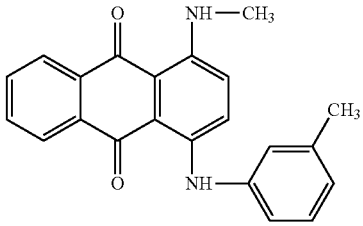

(13)-2

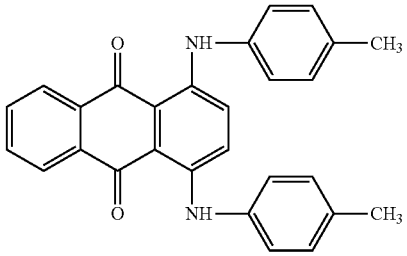

(13)-3

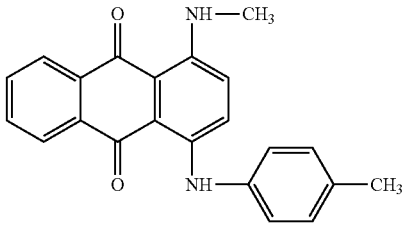

These dyes each are contained in the thermal transfer layer (dye layer) in an amount of preferably 10 to 90 mass %, more preferably 20 to 80 mass %, based on the thermal transfer layer.

A coating amount of the thermal transfer layer is preferably in the range of 0.1 to 1.0 g/m$^2$ (in solid content equivalent), and more preferably in the range of 0.15 to 0.60 g/m$^2$. Hereinafter, the term "coating amount" used herein is expressed by a solid content equivalent value, unless otherwise specified.

A film thickness of the thermal transfer layer is preferably in the range of 0.1 to 2.0 μm, and more preferably in the range of 0.1 to 1.0 μm.

In the present invention, preferred examples of a binder that can be used in the thermal transfer sheet include cellulose resins such as ethyl cellulose, hydroxyethyl cellulose, ethyl hydroxycellulose, hydroxypropyl cellulose, methyl cellulose, cellulose acetate and cellulose butyrate; vinyl resins such as polyvinyl alcohol, polyvinyl acetate, polyvinyl butyral, polyvinyl acetal, polyvinyl pyrrolidone and polyacrylamide; polyester resins; and phenoxy resins. Among those, butyral resins and polyester resins are particularly preferable, from the such a point of view as a heat resistance property and a migrating property of a dye.

More preferred polyester resins are those wherein at least a half (½) by molar ratio of an acid component of said polyester is terephthalic acid. Furthermore preferably at least two third (⅔) by molar ratio of the acid component is terephthalic acid. Most preferably at least three fourth (¾) by molar ratio of the acid component is terephthalic acid. These resins enable to prevent the ink sheet from welding with a heat-sensitive transfer image-receiving sheet. The polyester resins for use in the present invention may be obtained by a method described in, for example, JP-A-9-295389.

(Heat-resistant Sliding Layer)

The thermal transfer film used in the present invention has a heat-resistant sliding layer that is formed so as to contain a hardener, on one surface of the substrate, in order to prevent affections such as wrinkles upon printing and sticking that are caused due to heat from a thermal head. The heat-resistant sliding (lubricating) layer that is formed so as to contain a hardener, preferably contains a polymer as a binder. As the polymer, preferably used are any of thermoplastic resins such as polyester resins, polyacrylate resins, polyvinyl acetate resins, styrene acrylate resins, polyurethane resins, polyolefin resins, polystyrene resins, polyvinyl chloride resins, polyether resins, polyamide resins, polycarbonate resins, polyethylene resins, polypropylene resins, poly(meth)acrylate resins, polyacrylamide resins, polyvinylidene chloride resins, polyvinyl butyral resins, and polyvinyl acetal resins including polyvinyl acetoacetal resins, and silicone-modified thermoplastic resins. Of these polymers, the particularly preferable resins are polyvinyl butyral resins, polyvinyl acetal resins such as polyvinyl acetoacetal resins, and resins having a hydroxyl group capable of reacting with an isocyanate group, such as silicone-modified resins thereof.

In a preferred embodiment of the present invention, the above-described resins are preferably used together with a compound having 2 or more isocyanate groups as a cross-linking agent in order to impart a heat-resistant sliding layer heat resistance, film coating property, and adhesion with a substrate. As these isocyanate compounds, use can be made of any known isocyanate compounds that are usually employed in such an application of paints (coating), adhesives, or in synthesizing polyurethane or the like. For use in the present invention, these isocyanate compounds are also available by a commercial name such as Takenate (trade name, manufactured by Takeda Pharmaceutical), BURNOCK (trade name, manufactured by Dainippon Ink & Chemicals), CORONATE (trade name, manufactured by Nippon Polyurethane Industry), DURANATE (trade name, manufactured by Asahi Kasei Chemicals Corporation), and Dismodule (trade name, manufactured by Bayer).

The heat-resistant sliding layer for use in the present invention is a layer that is formed so as to contain a hardener (hardening agent). Herein, the term "a (heat-resistant sliding) layer that is formed so as to contain a hardener" means that the heat-resistant sliding layer is formed by using a coating mixture which contains a hardener, or that the heat-resistant sliding layer is formed by using a coating material containing a resin crosslinked with a hardener. Preferred examples of the hardener include the cross-linking agents (including hardeners) for the receptor layer in the heat-sensitive transfer image-receiving sheet as exemplified in the above.

A preferred addition amount of said isocyanate compound is in the range of 5 to 200 parts by mass based on 100 parts by mass of a polymer binder (resin binder) that constitutes the heat-resistant sliding layer. A ratio of NCO/OH is preferably in the range of from about 0.8 to about 2.0. Too small content of the isocyanate compound leads to a low cross-linking density, which results in dissatisfactory thermal resistance. Whereas, if the content is too much, disadvantages arise such that (1) it becomes difficult to control shrinkage of a coating film to be formed, (2) a hardening period of time becomes long, and (3) an unreacted NCO group remains in the heat-resistant sliding layer, and resultantly the remaining NCO group reacts with moisture in the air.

Examples of the slip characteristics-providing agent that is added to or overcoated on the heat-resistant sliding layer composed of the above-described resin include phosphoric acid esters, silicone oils, graphite powders, and silicone polymers such as silicone-based graft polymers, acrylosiloxanes, and arylsiloxanes. A preferred layer is composed of an polyol (for example, polyalcohol high molecular compound) and a polyisocyanate compound and a phosphoric acid ester compound. It is more preferable to add a filler further to the layer.

When the heat-resistant sliding layer is formed using the above-described materials in the present invention, there may be incorporated thermal releasing agents or sliding agents such as wax, higher fatty acid amides, esters, and surfactants, or organic powders such as fluorine-containing resins, or inorganic particles such as silica, clay, talc, and calcium carbonate in order to enhance the slip characteristics of the heat-resistant sliding layer.

The heat-resistant sliding layer is formed by the steps of: solving or dispersing the above-described materials in a suitable solvent such as acetone, methyl ethyl ketone, toluene, and xylene, to prepare a coating liquid (slip); coating and drying the coating liquid by usual coating means such as a gravure coater, a roll coater, and a wire bar; and crosslinking the coated layer by a thermal processing. Herein, the coating amount, namely thickness of the heat-resistant sliding layer is also important. In the present invention, a heat-resistant sliding layer having a satisfactory performance can be formed by controlling the amount (thickness) based on a solid content in the range of preferably 2.0 g/m$^2$, or less, more preferably from 0.1 to 2.0 g/m$^2$, furthermore preferably from 0.1 to 1.0 g/m$^2$.

In the image-forming method of the present invention, an image is formed, achieved by superposing a heat-sensitive transfer sheet on a heat-sensitive transfer image-receiving sheet so that the thermal transfer layer of the heat-sensitive transfer sheet can be contacted with a receptor layer of the heat-sensitive transfer image-receiving sheet; and giving thermal energy in accordance with image signals given from a thermal head.

As a means for providing heat energy in the thermal transfer, any of the conventionally known providing means may be used. For example, a heat energy of about 5 to 100 mJ/mm$^2$ is applied by controlling recording time in a recording device such as a thermal printer (trade name: Video Printer VY-100, manufactured by Hitachi, Ltd.), whereby the expected object can be attained sufficiently. The image-forming method of the present invention can be carried out, in the similar manner to that as described in, for example, JP-A-2005-88545.

From the viewpoint of shortening a time period taken until a consumer is provided a print, in the present invention, a printing time for one (1) print is preferably less than 8 seconds, and further preferably in the range of 3 to 8 seconds.

The present invention may be utilized for printers, copying machines and the like utilizing a heat-sensitive transfer recording system.

Advantages of the present invention are most effectively exhibited in the case where a transport speed of the heat-sensitive transfer image-receiving sheet at the time of image formation is in the range of preferably at least 125 mm/s, more preferably from 125 mm/s to 200 mm/s, furthermore preferably from 125 mm/s to 190 mm/s, and most preferably from 125 mm/s to 175 mm/s. Herein, "mm/s" means millimeter per second. Herein, the term "transport speed" of the heat-sensitive transfer image-receiving sheet at the time of image-formation means the speed with which the heat-sensitive transfer image-receiving sheet reciprocates underneath a thermal head.

Next, a thermal printer that can be used in the thermal sublimation recording or thermal transfer recording is described in detail.

As shown in FIG. 1, for example, a thermal printer is configured so that heat-sensitive transfer recording is performed by passing electric current through an exothermic part (exothermic element array) 11 of a thermal head 10 as a heat-sensitive transfer sheet (ink film) 15 is transported in the direction of the arrow by means of transport rollers (guide rollers) 28 and 29 and the resultant heat-sensitive transfer sheet thus-used is taken up so as to be wound in a ribbon cartridge. In the thermal transfer layer of the heat-sensitive transfer sheet 15, since each of a yellow, a magenta and a cyan colorant layer is formed successively corresponding to the area of the recording surface of a heat-sensitive transfer image-receiving sheet (recording paper) 14, respectively, the heat-sensitive transfer image-receiving sheet 15 is made to reciprocate underneath the thermal head 10 by switching the transport rollers 28 and 29 between the forward and backward rotational directions, and thereby all colors are given to the surface of the recording paper 14. The term "transport speed (carrier speed)" of the thermal transfer image-receiving sheet (14) upon the image formation means the speed with which the thermal transfer image-receiving sheet reciprocates underneath the thermal head (10) (the exothermic element array 11). In FIG. 1, the numeral 25 represents a platen drum, the numeral 26 represents a clamp member, and the numeral 27 represents a pulse motor.

Also, the heat-sensitive transfer image-receiving sheet for use in the present invention may be used in various applications enabling thermal transfer recording such as thin sheets or roll-like heat-sensitive transfer image-receiving sheets, cards, and transmittable type manuscript-making sheets, by appropriately selecting the type of support.

According to the image-forming method of the present invention, a print having a high density and an excellent image quality without defect, such as unevenness (blur) or wrinkle, can be obtained, with neither welding (fusion) between a thermal head and an ink sheet, nor welding between an ink sheet and an image-receiving sheet, even if a high speed processing, e.g. high speed printing, is performed.

The present invention will be described in more detail based on the following examples, but the invention is not intended to be limited thereto.

EXAMPLES

In the following Examples, the terms "part" and "%" are values by mass, unless otherwise specified.

(Production of Ink Sheet 101)

A polyester film having 6.0 μm in thickness (trade name: Lumirror, manufactured by Toray Industries, Inc.) was used as the substrate film. The following yellow, magenta and cyan compositions were respectively applied each as a monochromatic layer (coating amount: 1 g/m$^2$ when the layer was dried) on the front side of the film.

| <Composition solution for dye layer> | |
|---|---|
| Yellow composition (Yellow ink) | |
| Dye (7)-1 | 2.5 parts |
| Dye (8)-1 | 2.0 parts |
| Polyester 1 | 4.5 parts |
| Methyl ethyl ketone/toluene (1/1, at mass ratio) | 90 parts |
| Magenta composition (Magenta ink) | |
| Dye (9)-1 | 1.0 parts |
| Dye (10)-1 | 1.0 parts |

-continued

| <Composition solution for dye layer> | |
|---|---|
| Dye (11)-1 | 2.5 parts |
| Polyester 1 | 4.5 parts |
| Methyl ethyl ketone/toluene (1/1, at mass ratio) | 90 parts |
| Cyan composition (Cyan ink) | |
| Dye (12)-1 | 2.0 parts |
| Dye (13)-1 | 2.5 parts |
| Polyester 1 | 4.5 parts |
| Methyl ethyl ketone/toluene (1/1, at mass ratio) | 90 parts |

The composition of the above-described polyester 1 is set forth below.

Polyester 1

Polyester having a number-average molecular weight of 2,000, that was obtained by polymerizing the following molar ratio of acid and diol components as described below.

| | |
|---|---|
| Isophthalic acid | 5 |
| Terephthalic acid | 45 |
| Ethyleneglycol | 5 |
| Diethyleneglycol | 45 |

(Production of Ink Sheet 102)

As a substrate film, use was made of a 6,0-μm thick polyester film (trade name: Lumirror, manufactured by Toray Industries, Inc.). On a back surface of the film, a heat-resistant sliding (smoothing) layer (thickness of dried film: 1.0 μm) was formed. The Ink sheet 102 was prepared in the same manner as the above Sample 101, except for the heat-resistant sliding layer thus provided.

| <Coating solution for heat-resistant sliding layer 1> | |
|---|---|
| Polyvinylbutyral resin (trade name: S-LEC BX-1, manufactured by Sekisui Chemical Co., Ltd.) | 13.6 parts |
| Phosphoric ester (trade name: PLYSURF A208S, manufactured by DAI-ICHI KOGYOU SEIYAKU) | 0.8 parts |
| Methyl ethyl ketone | 42.9 parts |
| Toluene | 42.9 parts |

(Production of Ink Sheet 103)

As a substrate film, use was made of a 6,0-μm thick polyester film (trade name: Lumirror, manufactured by Toray Industries, Inc.). On a back surface of the film, a heat-resistant sliding layer (thickness of dried film: 1.0 μm) was formed. The Ink sheet 103 was prepared in the same manner as the above Sample 101, except for the heat-resistant sliding layer thus provided.

| <Coating solution for heat-resistant sliding layer 2> | |
|---|---|
| Polyvinylbutyral resin (trade name: S-LEC BX-1, manufactured by Sekisui Chemical Co., Ltd.) | 13.6 parts |
| Polyisocyanate hardening agent (trade name: Takenate D218, manufactured by Takeda Pharmaceutical Company Limited) | 0.6 parts |
| Phosphoric ester (trade name: PLYSURF A208S, manufactured by DAI-ICHI KOGYOU SEIYAKU) | 0.8 parts |

-continued

| <Coating solution for heat-resistant sliding layer 2> | |
|---|---|
| Methyl ethyl ketone | 42.5 parts |
| Toluene | 42.5 parts |

(Production of Image-receiving Sheets)

(Image-receiving Sheet 201)

Synthetic paper (trade name: Yupo FPG 200, manufactured by Yupo Corporation, thickness: 200 μm) was used as the support, and a receptor layer having the following composition was formed by coating on one surface of this support. The coating was carried out such that the amount of the receptor layer would be 4.0 g/m$^2$, and this layer was dried at 110° C. for 30 seconds.

| Coating solution for receptor layer 1 (Composition) | |
|---|---|
| Polyester resin (trade name: Vylon 200, manufactured by Toyobo Co., Ltd.) | 100 parts |
| Amino-modified silicone (trade name: X-22-343, manufactured by Shin-Etsu Chemical Co., Ltd.) | 3 parts |
| Epoxy-modified silicone (trade name: KF-393, manufactured by Shin-Etsu Chemical Co., Ltd.) | 3 parts |
| Toluene/methyl ethyl ketone (1 part/1 part) | 500 parts |
| (Coating amount) 20 ml/m$^2$ | |

(Image-receiving Sheet 202)

(Preparation of Support)

A pulp slurry was prepared from 50 parts of hardwood kraft pulp (LBKP) of acacia origin and 50 parts of LBKP of aspen origin, by beating these pulps by means of a disk refiner until Canadian standard freeness reached to 300 ml.

To the pulp slurry thus prepared were added, on a pulp basis, 1.3% of cationic-modified starch (CAT0304L, trade name, manufactured by Nippon NSC), 0.15% of anionic polyacrylamide (DA4104, trade name, manufactured by Seiko PMC Corporation), 0.29% of an alkylketene dimer (SIZEPINE K, trade name, manufactured by Arakawa Chemical Industries, Ltd.), 0.29% of epoxidated behenic acid amide, and 0.32% of polyamide polyamine epichlorohydrin (ARAFIX 100, trade name, manufactured by Arakawa Chemical Industries, Ltd.), and thereafter 0.12% of a defoaming agent was further added.

The resultant pulp slurry was made into paper by use of a fourdrinier paper machine. In a process of drying in which the felt side of web was pressed against a drum dryer cylinder via a dryer canvas, the web thus formed was dried under a condition that the tensile strength of the dryer canvas was adjusted to 1.6 kg/cm. Then, each side of the raw paper thus made was coated with 1 g/m$^2$ of polyvinyl alcohol (KL-118, trade name, manufactured by Kuraray Co., Ltd.) with a size press, then, dried and further subjected to calendering treatment. In this procedure, the papermaking was performed so that the raw paper had a grammage (basis mass) of 157 g/m$^2$, and the raw paper (base paper) having a thickness of 160 μm was obtained.

The wire side (back side) of the base paper obtained was subjected to corona discharge treatment, and thereto a resin composition, in which a high-density polyethylene having an MFR (which stands for a melt flow rate, and hereinafter has the same meaning) of 16.0 g/10 min and a density of 0.96 g/cm$^3$ (containing 250 ppm of hydrotalcite (DHT-4A (trade name), manufactured by Kyowa Chemical Industry Co., Ltd.) and 200 ppm of a secondary oxidation inhibitor (tris(2,4-di-t-butylphenyl)phosphite, Irugaphos 168 (trade name), manufactured by Ciba Specialty Chemicals)) and a low-density polyethylene having an MFR of 4.0 g/10 min and a density of 0.93 g/cm$^3$ were mixed at a ratio of 75 to 25 by mass, was applied so as to have a thickness of 21 g/m$^2$, by means of a melt extruder, thereby forming a thermoplastic resin layer with a matt surface. (The side to which this thermoplastic resin layer was provided is hereinafter referred to as "back side".) The thermoplastic resin layer at the back side was further subjected to corona discharge treatment, and then coated with a dispersion prepared by dispersing into water a 1:2 mixture (by mass) of aluminum oxide (ALUMINASOL 100, trade name, manufactured by Nissan Chemical Industries, Ltd.) and silicon dioxide (SNOWTEX O, trade name, manufactured by Nissan Chemical Industries, Ltd.), as an antistatic agent, so that the coating would have a dry mass of 0.2 g/m$^2$. Then, the front surface (front side) of the base paper was subjected to corona discharge treatment, and then coated with a low-density polyethylene having MFR 4.0 g/10 min and density 0.93 g/m$^3$ and containing 10 mass % of titanium oxide, by means of a melt extruder, so that the coated amount of the low-density polyethylene would be 27 g/m$^2$, thereby forming a thermoplastic resin layer with a specular surface.

(Preparation of Emulsified Dispersion)

An emulsified dispersion A was prepared in the following manner. The exemplified compound EB-9 was dissolved in a mixture of 42 g of a high-boiling solvent (Solv-5) and 20 ml of ethyl acetate, and the resultant solution was emulsified and dispersed in 250 g of a 20-mass % aqueous gelatin solution containing 1 g of sodium dodecylbenzenesulfonate by means of a high-speed stirring emulsification machine (dissolver). Thereto, water was added to prepare 380 g of the emulsified dispersion A.

In this procedure, the addition amount of compound EB-9 was adjusted so that the compound would be contained in an amount of 30 mol % in the emulsified dispersion A.

Coating solutions described below were applied to the support prepared in the foregoing manner so as to form a multilayer-structure coated product having an subbing layer 1, an subbing layer 2, a heat insulation layer, and a receptor layer, by simultaneous multi-layer coating, in increasing order of distance from the support, thereby making the image-receiving sheet 202. Compositions and coated amounts of the coating solutions used are shown below.

| (Composition) | |
|---|---|
| Coating solution for subbing layer 1 | |
| 3% aqueous gelatin solution | |
| NaOH for adjusting pH to 8 | |
| (Coating amount) 11 ml/m$^2$ | |
| Coating solution for subbing layer 2 | |
| Styrene-butadiene latex (SR103 (trade name), manufactured by Nippon A & L Inc.) | 60 parts |
| 6% aqueous solution of polyvinyl alcohol (PVA) | 40 parts |
| NaOH for adjusting pH to 8 | |
| (Coating amount) 11 ml/m$^2$ | |
| Coating solution for heat insulation layer | |
| Hollow latex polymer (MH5055 (trade name), manufactured by Zeon Corporation) | 60 parts |
| 10% Gelatin aqueous solution | 20 parts |
| Emulsified dispersion A prepared in the above | 20 parts |
| NaOH for adjusting pH to 8 | |

-continued

| (Composition) | |
|---|---|
| (Coating amount) 45 ml/m$^2$ | |
| Coating solution for receptor layer 2 | |
| Vinyl chloride-based polymer latex (VINYBLAN 900, trade name, produced by Nissin Chemical Industry Co., Ltd.) | 50 parts |
| Vinyl chloride-based polymer latex (VINYBLAN 270, trade name, produced by Nissin Chemical Industry Co., Ltd.) | 20 parts |
| 10% Gelatin aqueous solution | 10 parts |
| Emulsified dispersion A prepared in the above | 10 parts |
| Hardener (VS-7) | 0.2 part |
| Microcrystalline wax (EMUSTAR-042X (trade name), manufactured by Nippon Seiro Co., Ltd.) | 5 parts |
| Water | 5 parts |
| NaOH for adjusting pH to 8 | |
| (Coating amount) 18 ml/m$^2$ | |

The hardener (VS-7) used is the following compound.

$$CH_2{=}CHSO_2CH_2C({=}O){-}NHCH_2CH_2NHC({=}O){-}SO_2CH{=}CH_2$$

(Image Formation)

An image of 152 mm×102 mm size was output by a thermal transfer printer A (DPB1500 (trade name) manufactured by Nidec Copal Corporation) or a thermal transfer printer B (the printer described in FIG. 6 of JP-A-5-278247), using the above-described ink sheets and the above-described image-receiving sheets. As for the printer A, a transport speed of the heat-sensitive transfer image-receiving sheet at the time of image formation was 73 mm/sec. As to the thermal transfer printer B, the printing procedure was performed, setting a transport speed of the heat-sensitive transfer image-receiving sheet at the time of image formation to 125 mm/sec. At the time using the printer B, the heat value released from the thermal head of the thermal transfer printer B was controlled so that the density gradation obtained by the thermal transfer printer B would be the similar level to the density gradation obtained by printing procedure using the thermal transfer printer A. Evaluation was performed by the prints upon successively outputting ten sheets of black solid image.

In the above test, the welding (fusion) and the peeling off of ink in the output image were evaluated according to the following criteria:

5: Neither welding nor peeling off of ink was observed, and almost no unevenness was observed;

4: A little unevenness was observed, but neither welding nor peeling off of ink was found, and the resultant image had no problem in practice;

3: Neither welding nor peeling off of ink was observed, but apparent unevenness was found, and the resultant image had a problem in practice;

2: Both welding and peeling off of ink were observed, but the image-receiving sheet (print) could be ejected from the printer; and 1: The ink sheet and the image-receiving sheet were welded together, so that any print was not ejected from the printer.

Besides, occurrence of wrinkles was evaluated according to the following criteria:

○: No occurrence of wrinkles was found;

Δ: Occurrence of a few of wrinkles was found; and x: Occurrence of many wrinkles was found, and the resultant image had a practical problem.

The average maximum density (Dmax) was evaluated in terms of reflection density measured with a spectrophotometer (SpectroEye, trade name, made by GretagMacbeth AG).

The results are shown in Table 1.

TABLE 1

| | Image- | Printer A | | | Printer B | | |
|---|---|---|---|---|---|---|---|
| Ink sheet | receiving sheet | Welding, etc. | Dmax | Occurrence of wrinkle | Welding, etc. | Dmax | Occurrence of wrinkle |
| 101 | 201 | 3 | 1.82 | Δ | 1 | — | X |
| 102 | 201 | 3 | 1.84 | Δ | 2 | 1.68 | X |
| 103 | 201 | 4 | 1.86 | ○ | 4 | 1.70 | ○ |
| 101 | 202 | 3 | 2.02 | Δ | 3 | 2.02 | X |
| 102 | 202 | 4 | 2.06 | Δ | 3 | 2.08 | X |
| 103 | 202 | 5 | 2.12 | ○ | 5 | 2.15 | ○ |

When the ink sheet 101 and the image-receiving sheet 102 were combined, sticking due to welding of the image-receiving layer of the image-receiving sheet and the ink sheet occurred, and resultantly the evaluation of Dmax in this case was impossible.

As can be seen from the results shown in Table 1 above, when the combination of the ink sheet and the image-receiving sheet according to the present invention was used, substantially neither sticking due to welding of the ink sheet and the thermal head nor sticking due to welding of the image-receiving sheet and the ink sheet was observed, and occurrence of wrinkles was reduced to a remarkably low level, and besides, prints of high densities were obtained. In particular, these effects were noticeable even when high-speed printing was performed.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2006-064931 filed in Japan on Mar. 9, 2006, which is entirely herein incorporated by reference.

What we claim is:

1. An image-forming method, comprising the steps of:

superposing a heat-sensitive transfer sheet on a heat-sensitive transfer image-receiving sheet so that at least one receptor layer of the heat-sensitive transfer image-receiving sheet described below can be contacted with a thermal transfer layer of the heat-sensitive transfer sheet described below; and providing thermal energy in accordance with image signals given from a thermal head, thereby to form an image;

wherein the heat-sensitive transfer sheet comprises: said thermal transfer layer having a yellow colorant layer, a magenta colorant layer and a cyan colorant layer on one surface of a substrate film, and the magenta colorant layer comprises dyes represented by formulae (9), (10) and (11), and the cyan colorant layer comprises dyes represented by formulae (12) and (13); and a heat-resistant sliding layer containing a polymer obtained by reacting a compound having two or more isocyanate groups with a polymer on the other surface of the substrate film; and wherein the heat-sensitive transfer image-receiving sheet comprises: on a support, said at least one receptor layer that is formed by providing at least one kind of latex copolymer of vinyl chloride and an alkyl acrylate; and at least one heat insulation layer that contains non-foaming hollow polymeric particles formed of a polystyrene resin, acryl resin, or styrene/acryl resin in a size of 0.1 to 2 μm, and a water-soluble type resin as a binder:

Formula (9)

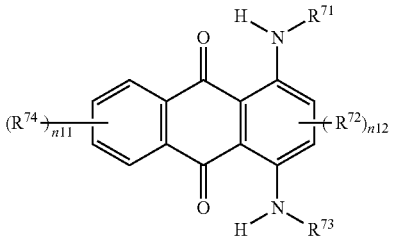

wherein, in formula (9), $R^{71}$ and $R^{73}$ each independently represent a hydrogen atom or a substituent; $R^{72}$ and $R^{74}$ each independently represent a substituent; n11 represents an integer of 0 to 4; and n12 represents an integer of 0 to 2;

Formula (10)

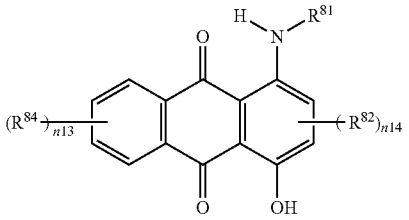

wherein, in formula (10), $R^{81}$ represents a hydrogen atom or a substituent; $R^{82}$ and $R^{84}$ each independently represent a substituent; n13 represents an integer of 0 to 4; and n14 represents an integer of 0 to 2;

Formula (11)

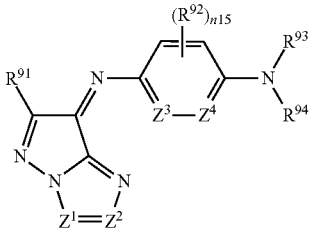

wherein, in formula (11), $R^{91}$ represents a hydrogen atom or a substituent; $R^{92}$ represents a substituent; $R^{93}$ and $R^{94}$ each independently represent a hydrogen atom or a substituent; n15 represents an integer of 0 to 2; one of $Z^1$ and $Z^2$ represents =N— and the other represents =C($R^{95}$)—; $Z^3$ and $Z^4$ each independently represents =N— or =C($R^{95}$)—; and $R^{95}$ represents a hydrogen atom or a substituent Formula (12)

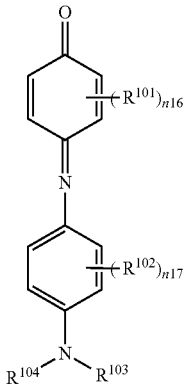

wherein, in formula (12), $R^{101}$ and $R^{102}$ each independently represent a substituent; $R^{103}$ and $R^{104}$ each independently represent a hydrogen atom or a substituent; and n16 and n17 each independently represent an integer of 0 to 4; and Formula (13)

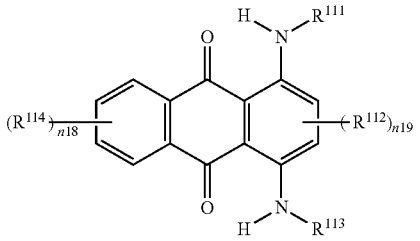

wherein, in formula (13), $R^{111}$ and $R^{113}$ each independently represent a hydrogen atom or a substituent; $R^{112}$ and $R^{114}$ each independently represent a substituent; n18 represents an integer of 0 to 4; and n19 represents an integer of 0 to 2.

2. The image-forming method as claimed in claim 1, wherein the receptor layer further contains a water-soluble polymer.

3. The image-forming method as claimed in claim 2, wherein at least one of the receptor layer containing the water-soluble polymer and the heat insulation layer containing the water-soluble polymer further contains a compound capable of forming crosslinkages between molecules of the water-soluble polymer, and the compound brings a part or all of the water-soluble polymer molecules into being crosslinked.

4. The image-forming method as claimed in claim 1, wherein a thickness of the heat-resistant sliding layer is in the range of 0.1 to 2.0 μm.

5. The image-forming method as claimed in claim 1, wherein the yellow colorant layer comprises at least one kind of a dye represented by formula (7) or (8):

Formula (7)

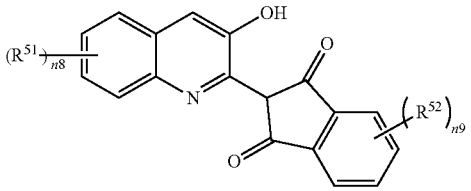

wherein, in formula (7), $R^{51}$ and $R^{52}$ each independently represent a substituent; n8 represents an integer of 0 to 5; and n9 represents an integer of 0 to 4; and Formula (8)

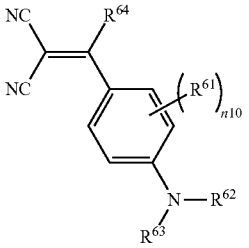

wherein, in formula (8), $R^{61}$ represents a substituent; $R^{62}$, $R^{63}$ and $R^{64}$ each independently represent a hydrogen atom or a substituent; and n10 represents an integer of 0 to 4.

6. The image-forming method as claimed in claim 1, wherein a transport speed of the heat-sensitive transfer image-receiving sheet at the time of image-forming is 125 mm per second or more.

7. The image-forming method as claimed in claim 1, wherein said at least one receptor layer is formed by providing at least two kinds of latex polymers.

8. The image-forming method as claimed in claim 1, wherein said at least one receptor layer is formed by providing at least two kinds of vinyl chloride-based latex polymers.

9. The image-forming method as claimed in claim 1, wherein the water-soluble type resin contained in the heat insulation layer is a gelatin.

10. The image-forming method as claimed in claim 1, wherein the receptor layer contains a gelatin.

11. The image-forming method as claimed in claim 1, wherein the heat-resistant sliding layer contains a phosphoric acid ester.

12. The image-forming method as claimed in claim 1, wherein a binder resin of the thermal transfer layer is a polyvinyl butyral resin or a polyester resin.

13. The image-forming method as claimed in claim 1, wherein the support is a laminated paper which is prepared by laminating a polyethylene on the both surfaces of a base paper, wherein the polyethylene laminated at the receptor layer side contains titanium oxide, and a charge controlling layer is provided on the polyethylene laminated at the opposite side of the receptor layer side.

14. The image-forming method as claimed in claim 1, wherein the polyethylene laminated at the opposite side of the receptor layer side is a blend of a low-density polyethylene and a high-density polyethylene.

* * * * *